US011686547B2

(12) United States Patent
Kras

(10) Patent No.: US 11,686,547 B2
(45) Date of Patent: Jun. 27, 2023

(54) SUPPRESSOR WITH REDUCED GAS BACK FLOW

(71) Applicant: Sig Sauer, Inc., Newington, NH (US)

(72) Inventor: Krzysztof J. Kras, Fremont, NH (US)

(73) Assignee: Sig Sauer, Inc., Newington, NH (US)

( * ) Notice: Subject to any disclaimer, the term of this patent is extended or adjusted under 35 U.S.C. 154(b) by 23 days.

(21) Appl. No.: 17/399,337

(22) Filed: Aug. 11, 2021

(65) Prior Publication Data

US 2022/0049920 A1 Feb. 17, 2022

Related U.S. Application Data

(60) Provisional application No. 63/064,547, filed on Aug. 12, 2020.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325; F41A 21/34
See application file for complete search history.

(56) References Cited

U.S. PATENT DOCUMENTS

| | | | |
|---|---|---|---|
| 748,157 | A | 12/1903 | Bouton |
| 822,127 | A | 5/1906 | Hugnagel |
| 916,885 | A | 3/1909 | Maxim |
| 1,000,702 | A | 8/1911 | Thurler |
| 1,341,363 | A | 5/1920 | Fiala |
| 1,427,802 | A | 9/1922 | Goodwin |
| 1,462,158 | A | 7/1923 | Wildner |
| 1,736,319 | A | 11/1929 | Maxim |
| 1,773,443 | A | 8/1930 | Wilman |
| 2,101,849 | A | 12/1937 | Green |
| 2,150,161 | A | 3/1939 | Green |

(Continued)

FOREIGN PATENT DOCUMENTS

| | | |
|---|---|---|
| EP | 1 764 577 A1 | 3/2007 |
| GB | 743111 | 1/1956 |

(Continued)

OTHER PUBLICATIONS

Volk, Oleg, AllOutdoor.com, "Thermal Defense Solutions: 3D-Printed Inconel Sound Suppresors" available at https://www.alloutdoor.com/2018/04/03/thermal-defense-solutions-3d-printed-steel-sound-suppressors/ (Apr. 3, 2018).

(Continued)

*Primary Examiner* — Jonathan C Weber
(74) *Attorney, Agent, or Firm* — Finch & Maloney, PLLC

(57) ABSTRACT

A suppressor for a firearm includes a baffle stack having an outer surface, the baffle stack comprising a plurality of baffles that define an inner chamber extending along a central axis of the baffle stack and a projectile pathway through the baffle stack along the central axis. An outer housing is around the baffle stack and has an inner surface separated from and confronting the outer surface of the baffle stack. An outer chamber is defined between the inner surface of the outer housing and the outer surface of the baffle stack. Flow-directing structures are in the outer chamber and are arranged to direct gases into or out of the inner chamber.

20 Claims, 8 Drawing Sheets

(56) References Cited

U.S. PATENT DOCUMENTS 2,165,457 A 7/1939 Cutts, Jr.
2,351,037 A 6/1944 Green
2,468,926 A 5/1949 Garrett
2,514,996 A 7/1950 Faust, Jr.
3,368,453 A 2/1968 Shaw
3,385,164 A 5/1968 Walther et al.
3,667,570 A 6/1972 WerBell, III
3,693,750 A 9/1972 Takkunen
3,786,895 A 1/1974 Perrine
4,291,610 A 9/1981 Waiser
4,454,798 A 6/1984 Shea et al.
4,482,027 A 11/1984 Gould
4,501,189 A 2/1985 Brandl et al.
4,510,843 A 4/1985 Rabatin
4,530,417 A 7/1985 Daniel
4,576,083 A 3/1986 Seberger, Jr.
4,583,445 A 4/1986 Blair
4,588,043 A 5/1986 Finn
4,907,488 A 3/1990 Seberger
4,930,396 A 6/1990 Johnson
4,946,105 A 8/1990 Pane, Jr. et al.
4,974,489 A 12/1990 Fishbaugh
5,010,676 A 4/1991 Kennedy
5,029,512 A 7/1991 Latka
5,036,747 A 8/1991 McClain, III
5,078,043 A 1/1992 Stephens
5,092,223 A 3/1992 Hudson
5,136,924 A 8/1992 Foerster et al.
5,164,535 A 11/1992 Leasure
5,425,299 A 6/1995 Teetzel
5,433,133 A 7/1995 La France
5,486,425 A 1/1996 Seibert
5,590,484 A 1/1997 Mooney et al.
5,656,166 A 8/1997 Linnersten et al.
5,661,255 A 8/1997 Webb, III
5,679,916 A 10/1997 Weichert
5,698,810 A 12/1997 Rose
5,777,258 A 7/1998 Soon
5,952,625 A 9/1999 Huff
6,079,311 A 6/2000 O'Quinn et al.
6,298,764 B1 10/2001 Sherman et al.
6,308,609 B1 10/2001 Davies
6,374,718 B1 4/2002 Rescigno et al.
6,376,565 B1 4/2002 Dyer et al.
6,425,310 B1 7/2002 Champion
6,490,822 B1 12/2002 Swan
6,499,245 B1 12/2002 Swan
6,575,074 B1 6/2003 Gaddini
6,732,628 B1 5/2004 Coburn et al.
6,792,711 B2 9/2004 Battaglia
6,796,214 B2 9/2004 Hausken et al.
6,959,509 B2 11/2005 Vais
7,000,547 B2 2/2006 Amick
7,036,259 B2 5/2006 Beretta
7,059,233 B2 6/2006 Amick
7,131,228 B2 11/2006 Hochstrate et al.
7,207,258 B1 4/2007 Scanlon
7,216,451 B1 5/2007 Troy
7,237,467 B1 7/2007 Melton
7,308,967 B1 12/2007 Hoel
7,325,474 B2 2/2008 Yoshimura et al.
7,353,740 B1 4/2008 Hoffman
7,412,917 B2 8/2008 Vais
7,587,969 B2 9/2009 Silvers
7,610,710 B2 11/2009 Brittingham
7,661,349 B1 2/2010 Brittingham
7,676,976 B2 3/2010 Dueck et al.
7,707,762 B1 5/2010 Swan
7,789,008 B2 9/2010 Petersen
7,823,314 B1 11/2010 Wheatley
7,832,323 B1 11/2010 Davies
7,836,809 B2 11/2010 Noveske
7,870,815 B2 1/2011 Hung
7,905,319 B2 3/2011 Sullivan
7,987,944 B1 8/2011 Brittingham et al.
8,167,084 B1 5/2012 Moore
8,196,701 B1 6/2012 Oliver
8,286,750 B1 10/2012 Oliver
8,307,946 B1 11/2012 Johnston
8,490,535 B1 7/2013 Moore et al.
8,516,941 B1 8/2013 Oliver
8,522,662 B2 9/2013 Presz, Jr. et al.
8,579,075 B2 11/2013 Brittingham et al.
8,671,818 B1 3/2014 Oliver
8,790,434 B1 7/2014 Oliver
8,826,793 B2 9/2014 Oliver
8,844,422 B1 9/2014 Klett
8,875,612 B1 11/2014 Klett et al.
8,973,481 B2 3/2015 Dueck et al.
9,052,152 B2 6/2015 Moss et al.
9,163,891 B1 10/2015 Dater et al.
9,175,920 B2 11/2015 Moore
9,194,640 B2 11/2015 Wirth et al.
9,207,033 B2 12/2015 Vais
9,239,201 B1 1/2016 Reis Green
9,316,456 B1 4/2016 Oliver
9,347,727 B1 5/2016 Cler
9,410,761 B2 8/2016 Morris et al.
9,423,198 B1 8/2016 Oliver
9,435,600 B2 9/2016 Oliver
9,482,484 B2 11/2016 Barney
9,500,427 B1 11/2016 Larue
9,709,354 B2 7/2017 Larue
9,835,399 B1 12/2017 Lessard
10,024,617 B1 7/2018 Moore et al.
10,030,929 B1 7/2018 Lessard
10,126,084 B1 11/2018 Oglesby
10,228,210 B2 3/2019 Parker
10,234,231 B2 3/2019 Gianelloni, III et al.
10,254,068 B2 4/2019 Piemme et al.
10,371,476 B1 8/2019 Oglesby
10,393,463 B1 8/2019 Sanders et al.
10,415,917 B2 9/2019 White
10,458,739 B2 10/2019 Smith
10,480,883 B2 11/2019 Smith
10,480,888 B2 11/2019 Barrett
10,502,513 B2 12/2019 Ellison et al.
10,533,819 B2 1/2020 Thomas
10,634,445 B1 4/2020 Klett
10,648,756 B2 5/2020 Mooty
10,655,926 B2 5/2020 Young et al.
10,746,491 B2 8/2020 Garst et al.
10,753,699 B2 8/2020 Klett et al.
10,690,432 B2 9/2020 Campbell et al.
10,890,403 B2 1/2021 Petersen
10,890,404 B2 1/2021 Petersen
2007/0107590 A1 5/2007 Silvers
2007/0107982 A1 5/2007 Sullivan
2007/0256347 A1 11/2007 Fitzpatrick et al.
2009/0200105 A1 8/2009 Geyer, III
2009/0235568 A1 9/2009 Auvine
2010/0048752 A1 2/2010 Vignola et al.
2010/0163336 A1 7/2010 Presz, Jr. et al.
2010/0199834 A1 8/2010 Dueck et al.
2011/0067950 A1 3/2011 Shults et al.
2014/0035076 A1 2/2014 Zhang et al.
2014/0262605 A1 9/2014 Washburn, III et al.
2014/0353076 A1 12/2014 Bethlenfalvy
2014/0360807 A1 12/2014 McKenzie
2015/0136519 A1 5/2015 Moore
2015/0253099 A1 9/2015 Shults
2015/0260472 A1 9/2015 Smith
2016/0084602 A1 3/2016 Smith
2016/0109205 A1 4/2016 Coppinger et al.
2016/0238335 A1 8/2016 Bertschinger et al.
2017/0160034 A1 6/2017 Parker
2017/0299314 A1 10/2017 Palu
2017/0321984 A1 11/2017 Palu et al.
2018/0135932 A1 5/2018 Fomczak
2018/0313626 A1 11/2018 Tomczak
2018/0313627 A1 11/2018 Tomczak
2018/0340750 A1 11/2018 Mooty
2019/0257607 A1 8/2019 Dobrinescu
2020/0064099 A1 2/2020 Young et al.

(56) References Cited

U.S. PATENT DOCUMENTS

| | | | | |
|---|---|---|---|---|
| 2020/0096279 | A1 | 3/2020 | Hibbitts et al. | |
| 2020/0116450 | A1 | 4/2020 | Ellison et al. | |
| 2020/0224989 | A1 | 7/2020 | Bundy et al. | |
| 2020/0240737 | A1 | 7/2020 | Wheeler et al. | |
| 2020/0263947 | A1 | 8/2020 | Calderwood et al. | |
| 2021/0003360 | A1* | 1/2021 | Kras | F41A 21/30 |
| 2021/0041200 | A1* | 2/2021 | Kras | F41A 21/30 |
| 2021/0071979 | A1 | 3/2021 | Plunkett, Jr. et al. | |

FOREIGN PATENT DOCUMENTS

| | | | | |
|---|---|---|---|---|
| GB | 2 288 007 | A | 4/1995 | |
| GB | 2 287 780 | A | 9/1995 | |
| WO | 9902826 | | 1/1999 | |
| WO | 2015016998 | A2 | 2/2015 | |
| WO | 2020081268 | A2 | 4/2020 | |
| WO | WO-2020176182 | A1 * | 9/2020 | F41A 21/30 |

OTHER PUBLICATIONS

OSS Suppressors.com Website, RAD 22 Suppressor, https://osssuppressors.com/suppressors/rimfire/ (last visited Apr. 29, 2019).
RetroRifles.com Website, M16A1 Birdcage Flash Hider, https://retrorifles.com/m16a1-birdcage-flash-hider-4-options/ (last visited Dec. 17, 2019).
Operators Suppressor Systems Info Sheet (2015).

* cited by examiner

SUPPRESSOR WITH REDUCED GAS BACK FLOW

RELATED APPLICATIONS

This application claims the benefit under 35 U.S.C. § 119(e) of U.S. Provisional Patent Application No. 63/064,547, titled SUPPRESSOR WITH REDUCED GAS BACK FLOW and filed on Aug. 12, 2020, the contents of which are incorporated herein by reference in its entirety.

FIELD OF THE DISCLOSURE

This disclosure relates to muzzle accessories for use with firearms and more particularly to a suppressor having reduced gas back flow.

BACKGROUND

Firearm design involves many non-trivial challenges. For example, rifles, machine guns, and other firearms have faced particular complications with reducing the audible and visible signature produced upon firing a round, while also maintaining the desired shooting performance. Suppressors are a muzzle accessory that reduces the audible report of the firearm by slowing the expansion and release of pressurized gases from the barrel. Visible flash can also be reduced by controlling the expansion of gases leaving the barrel as well as by controlling how muzzle gasses mix with ambient air.

Figure 1:
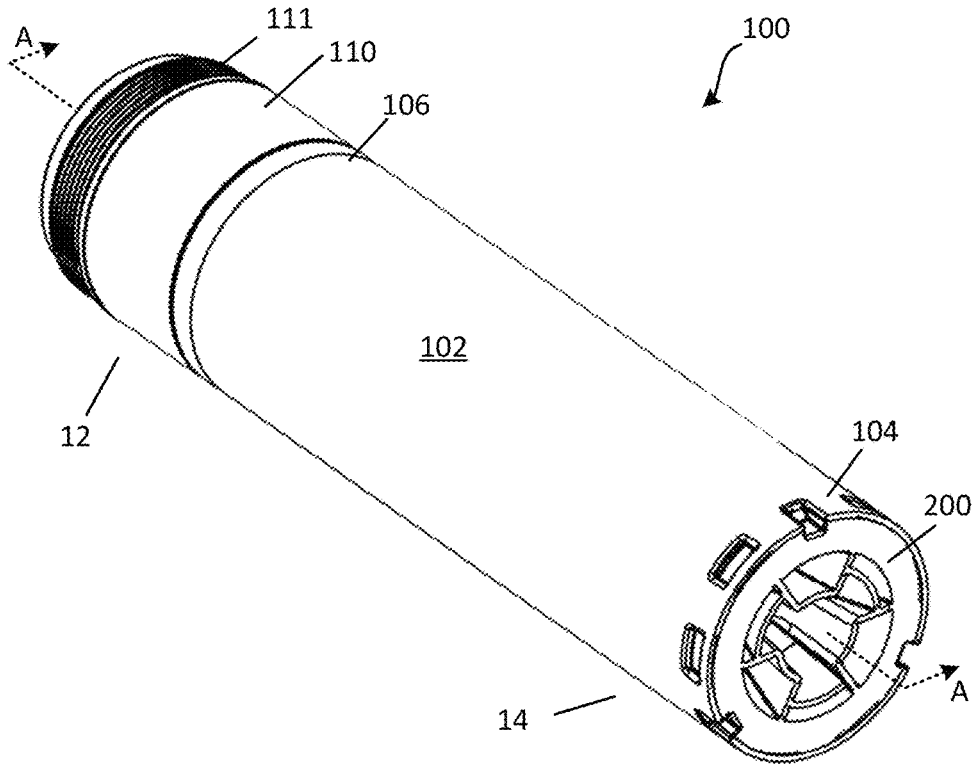
FIG. 1 illustrates a front and top perspective view of a suppressor, in accordance with one embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed herein is a suppressor assembly having reduced gas back flow and a suppressor baffle for use in a suppressor assembly, in accordance with some embodiments of the present disclosure. The disclosed suppressor is configured to be attached directly or indirectly to the distal end of a firearm barrel, such as via a muzzle adapter or a quick-disconnect mount.

In one example, a suppressor includes a baffle stack coaxially arranged within an outer housing. The baffle stack has a plurality of nested baffle cones connected to the baffle stack wall. The region within the baffle stack wall defines an inner chamber that includes the path of the projectile. An outer chamber is defined between the outside surface of the baffle stack wall and the inside surface of the outer housing, such that the outer chamber is concentric with and positioned radially outside of the inner chamber. Flow-directing structures, such as vanes, in the outer chamber can be configured to direct gas flows in a non-linear path forward toward the distal end as well. Flow-directing structures can also promote gas flow through ports from the outer chamber to the inner chamber or vice versa. Some features of the baffle stack can be employed to amplify a top-to-bottom gas flow through the suppressor that results in better attenuation of the audible signature and reduced back flow of pressurized gases into the firearm's receiver. In some embodiments, the suppressor can include an integrated flash hider in the distal end of the suppressor assembly to reduce the visible signature. Numerous variations and embodiments will be apparent in light of the present disclosure.

GENERAL OVERVIEW

As noted above, non-trivial issues may arise that complicate weapons design and performance of firearms. For instance, one non-trivial issue pertains to the fact that the discharge of a firearm normally produces an audible and visible signature resulting from rapidly expanding propellant gases and from the projectile leaving the muzzle at a velocity greater than the speed of sound with respect to ambient conditions. It is generally understood that attenuating the audible report may be accomplished by slowing the rate of expansion of the propellant gases. Slowing gas expansion and delaying gas venting from the suppressor can be accomplished by forcing the gas to take a longer flow path through the suppressor, such as around baffles.

Reducing the visible signature or flash also can be accomplished by controlling the expansion of gases exiting the muzzle. Muzzle flash may include two main components. A red glow may be visible where gas flow transitions from supersonic to subsonic flow, sometimes referred to as a Mach disk or flow diamond. A brighter or white flash may be visible when oxygen from the ambient air ignites and burns with the hot propellant gases. Visible flash can be reduced by reducing the amount of ambient air that mixes with gases exiting the muzzle (e.g., by reducing turbulence), by restricting the gas expansion, or both. More specifically, it has been found that the size of the Mach disk and the position of the Mach disk relative to the muzzle can be controlled with certain features of the flash hider. Reducing flash is a function of temperature, pressure, barrel length, and the type of ammunition being fired, among other factors. Reducing one component of muzzle flash may enhance another component of flash, as will be appreciated.

Suppressors can have additional challenges associated with reducing visible flash and attenuating sound. In some suppressor designs, for example, slowing down the expansion and release of combustion gases from the muzzle when a shot is fired can undesirably result in containment, trapping, and delayed release of pressurized gas from the suppressor, which results in a localized volume of high-pressure gases. As a natural consequence, the pressurized gases within the suppressor take the path of least resistance to regions of lower pressure. Such condition is generally not problematic in the case of a bolt-action rifle because the operator opens the bolt to eject the spent casing in a time frame that is much greater than the time required for the gases in the suppressor to disperse through the distal (forward) end of the suppressor. However, in the case of a semi-automatic rifle, automatic rifle, or a machine gun, the bolt opens very quickly after firing (e.g., within 1-10 milliseconds) to reload the firearm for the next shot. In this short time, pressurized gases remain in the suppressor and the barrel. Some of the gases therefore follow the path of least resistance through the barrel and out through the chamber towards the operator's face rather than following the tortuous path through the suppressor. To avoid introducing particulates and combustion residue to the chamber, and to avoid combustion gases being directed towards the operator's face for autoloading firearms, it would be desirable to reduce the pressure build up within the suppressor and therefore reduce or eliminate back flow into the firearm's receiver. Additionally, it would be desirable to reduce back flow of gases into the receiver while at the same time retaining effective sound suppression and effective flash suppression.

Thus, reducing the visible signature while also reducing the audible signature of a firearm presents non-trivial challenges. To address these challenges and others, and in accordance with some embodiments, the present disclosure includes a suppressor having reduced gas back flow, a suppressor baffle for use in a suppressor assembly, and a suppressor with an integrated flash hider.

In one embodiment, a suppressor includes a baffle stack coaxially arranged within an outer housing. The baffle stack includes a series of nested baffles each having a baffle cone connected to the baffle stack wall and tapering rearward to a central opening on the bore axis. The region within the baffle stack wall defines an inner chamber that includes the path of the projectile. An outer chamber is defined between the outside surface of the baffle stack wall and the inside surface of the outer housing, such that the outer chamber is concentric with and positioned radially outside of the inner chamber. The inner and outer chambers can fluidly communicate via ports in the baffle stack wall, in some embodiments. The outer chamber provides a generally forward flow path for a significant portion of the combustion gases and reduces the back flow of pressurized gases into the receiver.

The outer chamber includes a plurality of vanes or other flow-directing structures to direct gases along a tortuous path as the gases flow distally therethrough. The flow-directing structures can result in localized regions of higher pressure or lower pressure that are useful to direct gases into or out of ports. For example, the vanes are connected to the outer surface of the baffle stack wall and are arranged in diverging pairs and converging pairs, such as in a zig-zag or herringbone-type pattern on the outside of the baffle stack. A port located between converging vanes generally directs gases into the baffle stack as a result of a localized region of higher pressure between the converging vanes. Similarly, a port located between diverging vanes generally draws gases out of the baffle stack as a result of a localized region of lower pressure. Ports and flow-directing structures can be positioned to direct gases from the outer chamber to the inner chamber and vice versa.

When the firearm is discharged, gases exit the barrel and flow into the suppressor along the bore axis. Gases initially expand in a blast chamber in the proximal end portion of the suppressor. A first portion of combustion gases continues along the bore axis and enters the baffle stack through a central opening in the first baffle, sometimes referred to as the blast baffle. The central opening to each subsequent baffle cone can have a step or notch, for example, to direct gases away from the central axis as gases pass through the opening. A second portion of combustion gases flows through the outer chamber between the baffle stack and outer housing. The second portion of gases may include gases deflected outward by the conical taper of the first baffle as well as gases that have expanded away from the central axis in the blast chamber, for example. Gases in the outer chamber are largely isolated from and can vent semi-independently of gases flowing through the inner chamber.

The lower portion of a suppressor may pressurize at a different rate (e.g., slower) than the upper portion of the suppressor, resulting in pressure gradients within the suppressor. For example, the inner chamber may exhibit lower pressure in the upper half and higher pressure in the lower half. Similarly, the outer chamber may exhibit higher pressure in the upper half and lower pressure in the lower half.

To more evenly fill the suppressor and to promote gas flow through most of the suppressor volume, some gases may be directed generally downward as the gases flow through the suppressor. In one embodiment, combustion gases are generally directed downward through the baffle stack as a result of one or more features that include (i) gases entering the baffle stack through inlet ports along the upper part of the baffle stack wall, (ii) central openings in each baffle cone that are shaped to promote downward flow through the central opening, and (iii) outlet ports along the lower portion of the baffle stack wall that direct gases from the inner chamber to the lower portion of the outer chamber. At least some baffle cones can further define through openings in the baffle cone wall so that gases near an outer portion of a baffle can pass to the next baffle rather than stalling at a dead end between the cone and the outer wall of the baffle stack, for example. In one example, through openings occur in every other baffle cone and outlet ports are also adjacent every other baffle cone such that the outlet ports are interspersed axially with the through openings in the radially outer portion of the baffle cone.

Compared to traditional baffle suppressors, suppressors of the present disclosure can reduce localized volumes of high-pressure gas and the resulting flow of combustion gases backward through the barrel and into the rifle's receiver after firing, such as may occur in semiautomatic and automatic rifles. The inner and outer chambers divide the gases into two volumes that can, in some embodiments, better expand to fill and flow through the entire suppressor volume, which reduces localized areas of high pressure in the suppressor. The inner chamber includes a plurality of baffle cones that promote gas expansions and a tortuous path for gases, which induces turbulence and energy dissipation within the inner chamber. In accordance with some embodiments, adjacent baffle cones are nested such that the central opening of one baffle cone is positioned within the volume of an adjacent baffle cone. For example, adjacent baffle cones overlap by about 40-60% of the axial length of the conical taper.

In accordance with one embodiment of the present disclosure, the baffle stack includes a plurality of suppressor baffles that include features to amplify the downward flow of gases. Such baffles can be assembled together to define the baffle stack. In one embodiment, a suppressor baffle has a cylindrical outer baffle wall segment extending along a longitudinal axis. One or more baffle cones are connected to the outer baffle wall segment and taper rearward to a central opening. For example, the suppressor baffle has two baffle cones connected to the outer baffle wall segment. A first baffle cone connects to a proximal end of the outer baffle wall segment and a second baffle cone connects to a middle or distal portion of the outer baffle wall segment so that the second cone is axially spaced from and extends into the volume of the first cone. The outer baffle wall segment defines at least one inlet port along an upper portion of the outer baffle wall and at least one outlet port in a lower portion of the outer baffle wall. In some embodiments, the inlet and/or outlet port is located distally of the second cone. Optionally, the central opening to each baffle cone is notched or otherwise partly enlarged so that an upper portion (e.g., upper half) of the opening, as viewed looking along the central axis, has a larger cross-sectional area than the lower portion (e.g., lower half) of the central opening. Accordingly, gases tend to flow through the central opening in a downward direction that promotes off-axis flow.

Flow-directing structures are connected to the outside of the outer baffle wall segment, in accordance with some embodiments. For example, vanes are arranged in a zig-zag or herringbone-like pattern on the outside of the outer baffle wall segment so that the vanes define converging and diverging pairs of vanes. The inlet ports in the upper portion of the outer baffle wall are positioned between converging vanes, which provide regions of localized high pressure to direct gas flow into the baffle. Outlet ports in the lower portion of the outer baffle wall are positioned between diverging vanes, which provide regions of localized low pressure to direct gas flow out of the baffle. The outer baffle wall segment optionally defines additional inlet or outlet ports at various locations. Optionally, the lower and radially outer portion of the first or second baffle cone defines a through opening that provides an alternate path for gas to pass through the baffle cone.

In accordance with some embodiments, the distal end portion of the suppressor includes an integral flash hider to reduce visible flash. For example, the flash hider can be welded to, formed as a single monolithic part with, or otherwise attached to the end of a cylindrical outer wall and/or to the baffle stack of the suppressor assembly. In one embodiment, the flash hider has a first or inner flash hider portion configured to vent combustion gases entering the flash hider through a central opening. A second flash hider portion is configured to vent off-axis gases and/or gases flowing through the outer chamber of the suppressor.

In one example, a flash hider has an outer wall that expands along a central axis from a proximal end to a distal end. The first flash hider portion includes an inner volume and a plurality of outer volumes. The second flash hider portion includes gas passageways interspersed circumferentially with the outer volumes of the first flash hider portion, where the gas passageways are isolated from the central and outer volumes and communicate via vent openings to an outside of the flash hider body. For example, the flow partitions are hollow and define gas passageways that are isolated from the central and outer volumes by the wall defining each gas passageway. For example, each flow partition generally has a trapezoidal U-shape with straight sides connecting an arcuate inner surface to the outer wall. The negative space between adjacent flow partitions defines an outer volume that is continuous with the central volume, where the central volume and the outer volumes comprise the first flash hider portion. The second flash hider portion includes gas passageways through the hollow flow partitions. Gases enter the second flash hider portion through openings in the outer wall.

A flash hider or a suppressor including the flash hider can be manufactured by molding, casting, machining, 3-D printing, or other suitable techniques. For example, additive manufacturing—also referred to as 3-D printing—can facilitate manufacture of complex geometries that would be difficult or impossible to make using conventional machining techniques. One additive manufacturing method is direct metal laser sintering (DMLS).

As will be appreciated in light of this disclosure, and in accordance with some embodiments, a suppressor assembly configured as described herein can be utilized with any of a wide range of firearms, such as, but not limited to, machine guns, semi-automatic rifles, short-barreled rifles, submachine guns, and long-range rifles. In accordance with some example embodiments, a suppressor configured as described herein can be utilized with firearms chambered for ammunition sized from 0.17 HMR rounds to 30 mm autocannon round, including 5.56×45 mm NATO rounds, 7.62×51 mm rounds, 7.62×39 mm rounds, 7.62×35 mm rounds (a.k.a. 300 BLK), 6.5 mm Creedmoor rounds, 6.8×51 mm rounds, 0.338 Norma Magnum rounds, or 0.50 BMG rounds, to name a few examples. Some embodiments of the present disclosure are particularly well suited for ammunition having a muzzle velocity below about 1100 ft/second, such as subsonic ammunition, pistol ammunition, and rifle cartridges known as the 300 Whisper (a.k.a. 300-221). Other suitable host firearms and projectile calibers will be apparent in light of this disclosure.

Although generally referred to a suppressor herein for consistency and ease of understanding the present disclosure, the disclosed suppressor is not limited to that specific terminology and alternatively can be referred to as a silencer, sound attenuator, a sound moderator, a signature attenuator, or other terms. Similarly, although generally referred to herein as a flash hider for consistency and ease of understanding the present disclosure, the disclosed flash hider is not limited to that specific terminology and alternatively can be referred to, for example, as a flash suppressor, a flash guard, a suppressor end cap, or other terms. As will be further appreciated, the particular configuration (e.g., materials, dimensions, etc.) of a suppressor assembly, suppressor baffle, and a flash hider as described herein may be varied, for example, depending on whether the target application or end-use is military, law enforcement, or civilian in nature. Numerous configurations will be apparent in light of this disclosure.

Example Suppressor Configurations

Figure 2:
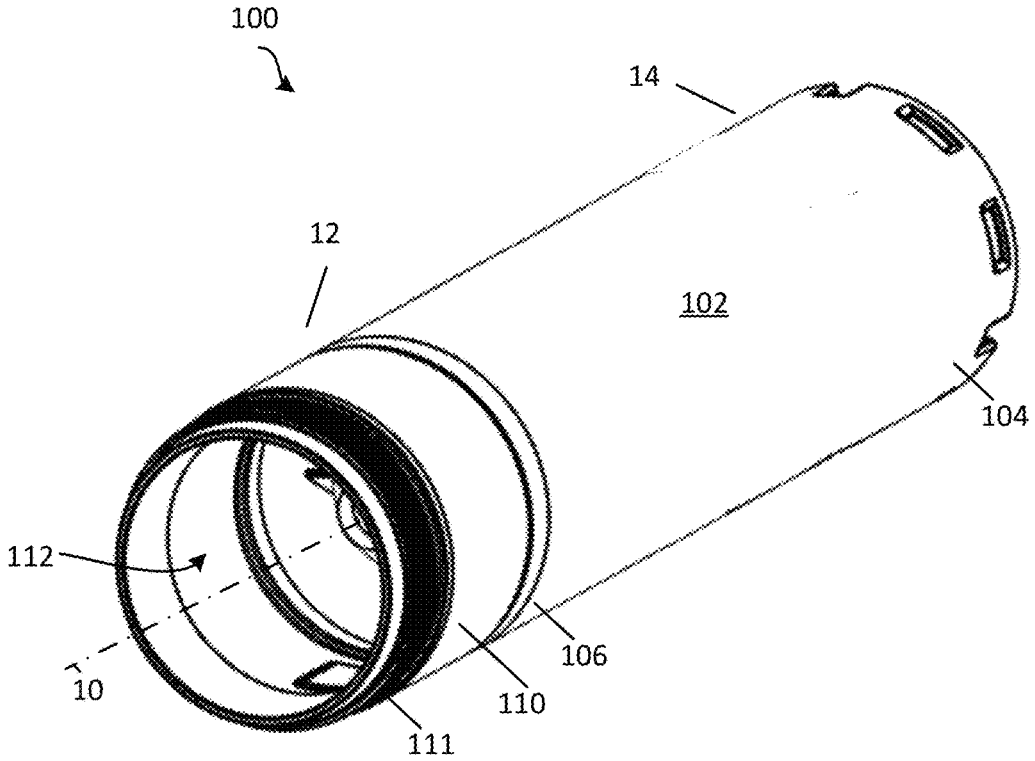
FIG. 2 illustrates a rear perspective view of the suppressor of FIG. 1 and shows a blast chamber in the proximal end portion, in accordance with one embodiment of the present disclosure.

FIGS. 1 and 2 illustrate front and rear perspective views, respectively, of a suppressor assembly 100 (or simply "suppressor" 100), in accordance with an embodiment of the present disclosure. In this example, the suppressor 100 has a cylindrical shape that extends along a central axis 10 (may also be referred to as a bore axis) from a proximal end portion 12 to a distal end portion 14. The cylindrical shape is not required, and other geometries are acceptable, including a cross-sectional shape that is hexagonal, octagonal, rectangular, oval, or elliptical, for example. An outer housing 102 extends between a distal housing end portion 104 and a proximal housing end portion 106. A flash hider 200 is retained in the proximal housing end portion 106. A mount 110 is secured to the proximal housing end portion 106, such as by threaded engagement, and has an outside surface that is generally continuous with that of the outer housing 102. The mount 110 includes a threaded portion 111 that can be used to connect to an adapter or quick-disconnect assembly (not shown), for example. In this example, the mount 110 is hollow and defines an open blast chamber 112 positioned proximally of the baffle stack 120 (shown in FIGS. 3-7) located inside of the outer housing 102. In one embodiment, the blast chamber 112 is sized to accommodate a muzzle brake, flash hider, or similar muzzle attachment on the barrel of the firearm. For example, the suppressor 100 is constructed to be installed over a muzzle attachment attached to the firearm barrel, where the muzzle attachment is received in the blast chamber 112; however, no such muzzle attachment is required for effective operation of suppressor 100. In one example embodiment, the blast chamber 112 has an axial length from 0.5 inch to about 3 inches. Numerous variations and embodiments will be apparent in light of the present disclosure.

Figure 3:
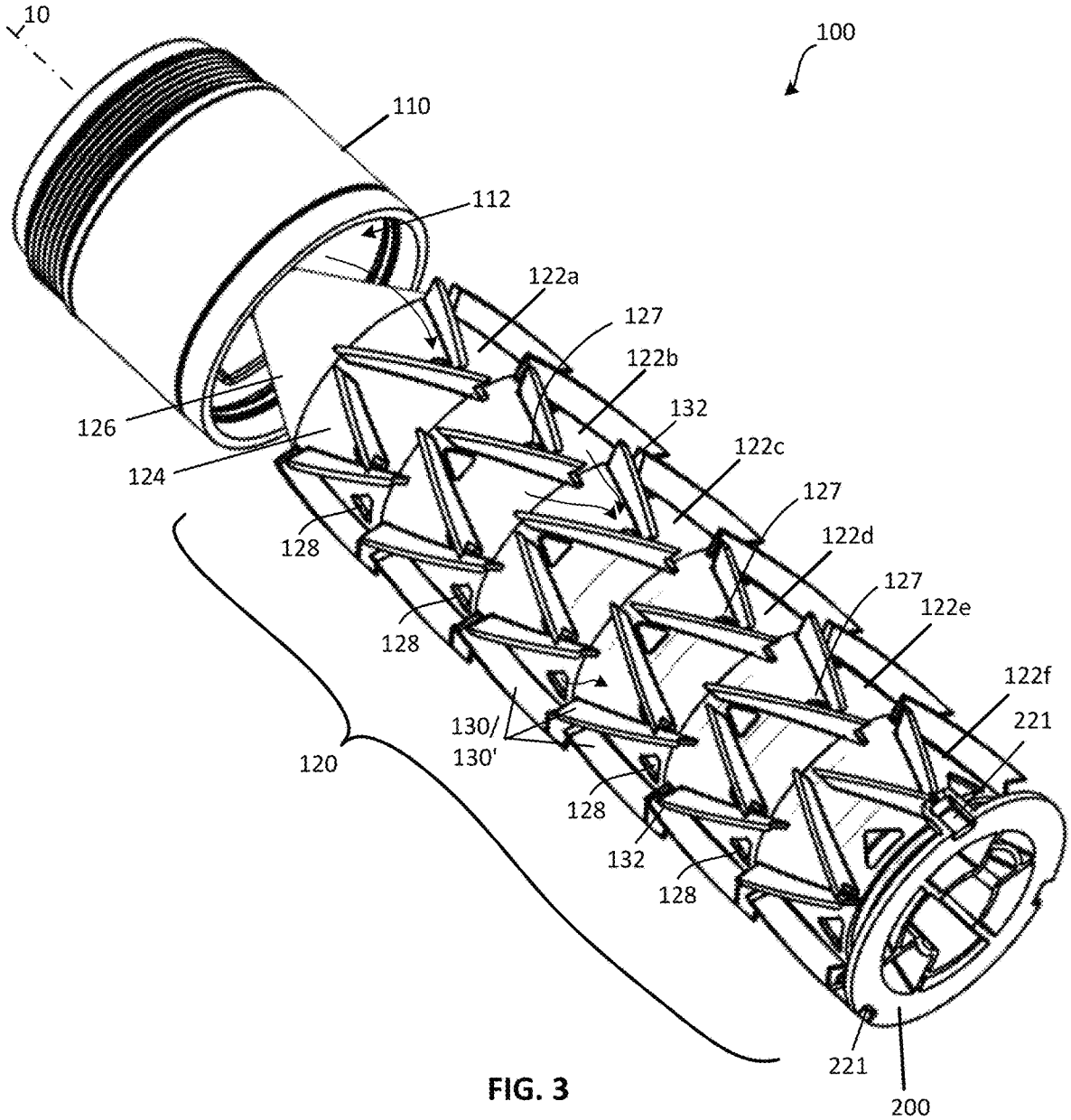
FIG. 3 illustrates a top, front, and side perspective view of a suppressor shown without the outer housing to expose portions of the baffle stack, in accordance with an embodiment of the present disclosure.

FIG. 3 is a top, front, and side perspective view showing the suppressor 100 of FIGS. 1-2 with the outer housing 102 omitted to reveal the baffle stack 120. In some embodiments, the baffle stack 120 includes a plurality of individual baffles 122, each of which includes an annular (e.g., cylindrical) baffle wall segment 124 and one or more baffle cones 126 connected to the baffle wall segment 124. The baffle wall segment 124 is illustrated as having a cylindrical shape, but other shapes are acceptable including a rectangular, hexagonal, octagonal, oval, or other cross-sectional geometry.

In this example, the baffle stack 120 has three or more baffles 122 sequentially arranged along the central axis 10 so that the central openings 136 of the baffles 122 define a projectile flow path therethrough. In this example, baffles 122 include a first baffle 122(*a*), also referred to as a blast baffle, and additional baffles 122(*b*)-122(*f*). The baffle wall segments 124 abut one another and combine to define a continuous or substantially continuous baffle stack wall 125. For example, a substantially continuous baffle stack wall 125 may exhibit seams between adjacent baffles 122. In some embodiments, the baffle wall segments 124 are connected, such as by welding, a threaded interface, an interference fit, or being formed as a single monolithic structure. For example, the baffle stack 120 can be made as a single monolithic structure using additive manufacturing techniques such as direct metal laser sintering (DMLS). In embodiments where the baffle stack 120 is a monolithic structure, the baffle stack wall 125 may not distinctly define individual baffle wall segments 124. Nonetheless, the principles discussed herein for baffle wall segments 124 can be applied to a portion of a single baffle stack wall 125.

In some embodiments, all baffles 122 can have substantially the same geometry. In other embodiments, the first baffle 122(*a*) may be differently configured so as to function as a blast baffle. For example, the first baffle 122*a* may include or lack features that distinguish it structurally from other baffles 122*b*-122*f*, but it nonetheless may function as a blast baffle, and be referred to as such in that it is subject to a blast of high temperature gases exiting the barrel, as will be appreciated. In this example, the first baffle 122(*a*) can be distinguished from baffles 122(*b*)-122(*f*) in that the central opening 136 is circular and the central opening 136 of baffles 122(*b*)-122(*f*) may be non-circular. Baffles 122 are discussed in more detail below. Part of the baffle cone 126 of the first baffle 122(*a*) is shown in this example as extending into the blast chamber 112, but this is not required and the baffle cone 126 can end distally of or at the end of the mount 110.

The flash hider 200 is installed adjacent the final baffle 122, here baffle 122(*f*), with portions of the flash hider 200 received in the baffle cone 126 of the final baffle 122(*f*). The flash hider 200 can be secured to the baffle stack 120 by welding, threaded engagement, a frictional fit, or other by engagement with the outer housing 102. Optionally, the flash hider 200 defines recesses 221 in the distal end portion to facilitate engagement with a spanner or other tool used to assemble the suppressor 100 with the mount 110, or to screw the suppressor 100 onto the barrel or barrel attachment. Flash hider 200 is discussed in more detail below.

The baffle stack 120 includes flow-directing structures 130 on the outside of the baffle stack wall 125. In various examples, the flow-directing structures 130 can be connected to one or both of an outer surface of the baffle stack wall 125 and an inner surface of the outer housing 102. The flow-directing structures 130 can be vanes, walls, ridges, partitions, or other obstructions that cause a non-linear gas flow through the outer chamber 109. In some examples, flow-directing structures 130 can include alternating vanes that extend part way upwardly and/or downwardly between the outer housing 102 and the baffle stack wall 125. In some embodiments the alternating position of the flow-directing structures 130 can define an oscillating flow path for the gases as they flow towards exit at the distal end of the suppressor 100.

In the example of FIG. 3, the flow-directing structures 130 are configured as vanes 130' with a planar or helical shape. The vanes 130' are arranged around the outside of the baffle stack wall 125 in a zig-zag or herringbone-type pattern. For example, each baffle wall segment 124 has vanes 130' that extend transversely to the central axis 10 and have an axial length roughly equal to the axial length of the baffle wall segment 124. In some instances, part of a vane 130' may extend beyond the end of the baffle wall segment 124, such as illustrated. Ends of adjacent vanes 130' can be directed towards each another to make a V shape or vertex 132, even though the ends of vanes 130' may or may not contact each other. Each vertex 132 is positioned to point generally along the central axis 10. As can be seen in FIG. 3, the vanes 130' are generally arranged in a grid with vertices 132 in lines parallel to the central axis 10 and in rows that extend circumferentially around the baffle stack 120. Vanes 130' defining a vertex 132 pointing proximally can be referred to as diverging vanes 130' and vanes 130' defining a vertex 132 pointing distally can be referred to as converging vanes.

Ports 127 positioned between converging vanes 130' are generally located in a localized region of high pressure that directs gases from the outer chamber 109 into the inner chamber 108, and therefore may be referred to as inlet ports 127. Note that inlet ports 127 function most often to direct gas flow into the baffle stack, but that fluid dynamics within the suppressor 100 depends on many factors and the flow through inlet ports 127 could reverse directions in some circumstances such that gases flow through inlet ports 127 from the inner chamber 108 to the outer chamber 109. Ports 128 positioned between diverging vanes 130' are generally located in a localized region of low pressure that directs gases from the inner chamber 108 to the outer chamber 109, and therefore may be referred to as outlet ports 128. Note, however, that outlet ports 128 between diverging vanes can function as an inlet port or an outlet port, depending on other nearby structures and flow conditions within the suppressor 100, as will be appreciated. For example, outlet ports 128 adjacent the distal wall 204 may behave as inlet ports at some point during the firing cycle.

Figure 4:
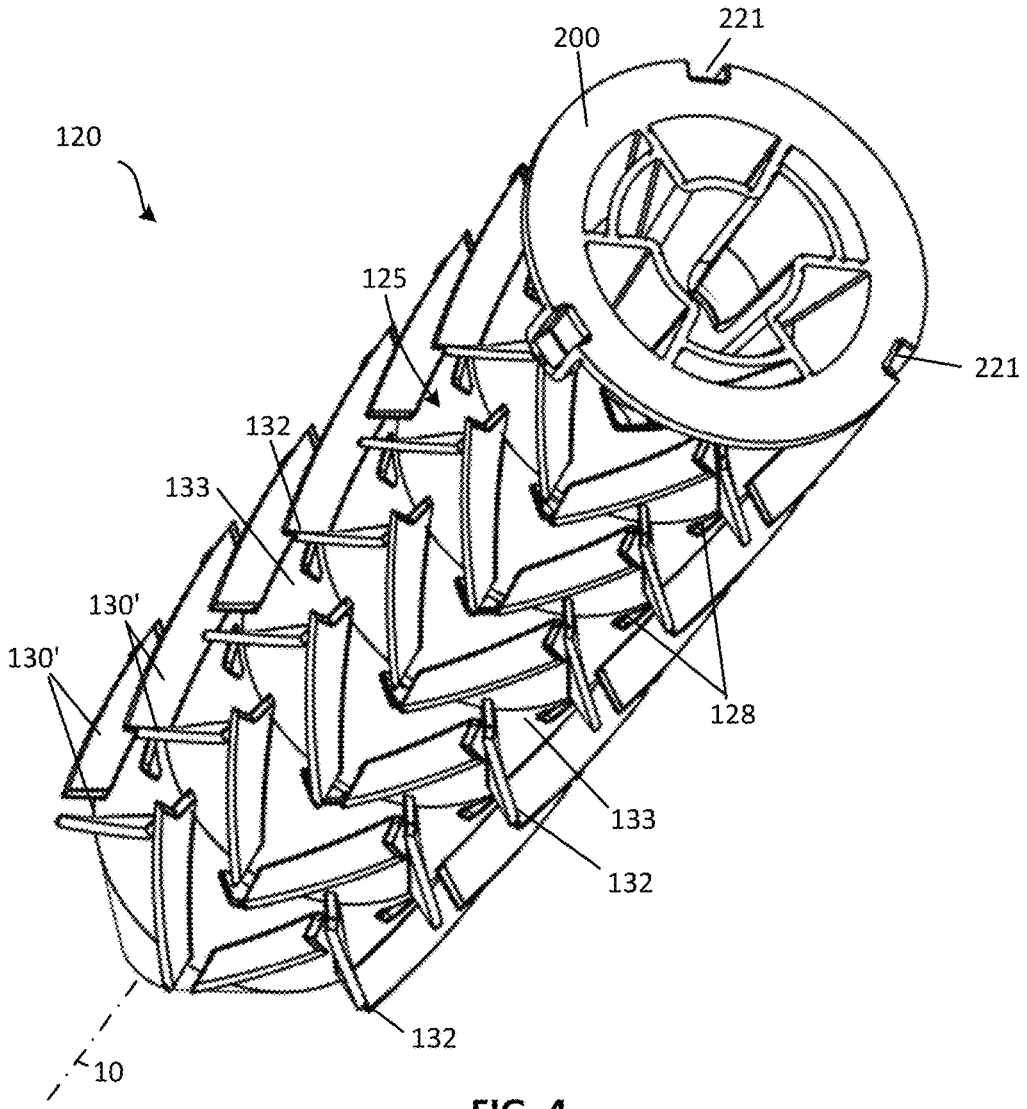
FIG. 4 illustrates a bottom, side, and front perspective view of a baffle stack with flash hider in the distal end, in accordance with an embodiment of the present disclosure.

FIG. 4 illustrates a bottom perspective view of the baffle stack 120 of FIG. 3, in accordance with an embodiment. Outlet ports 128 along the bottom portion of the baffle stack 120 are positioned at the open mouth 133 of diverging vanes 130'. At this location, a localized region of low pressure draws gases through the outlet port 128 from the inner chamber 108 to the outer chamber 109.

Figure 5:
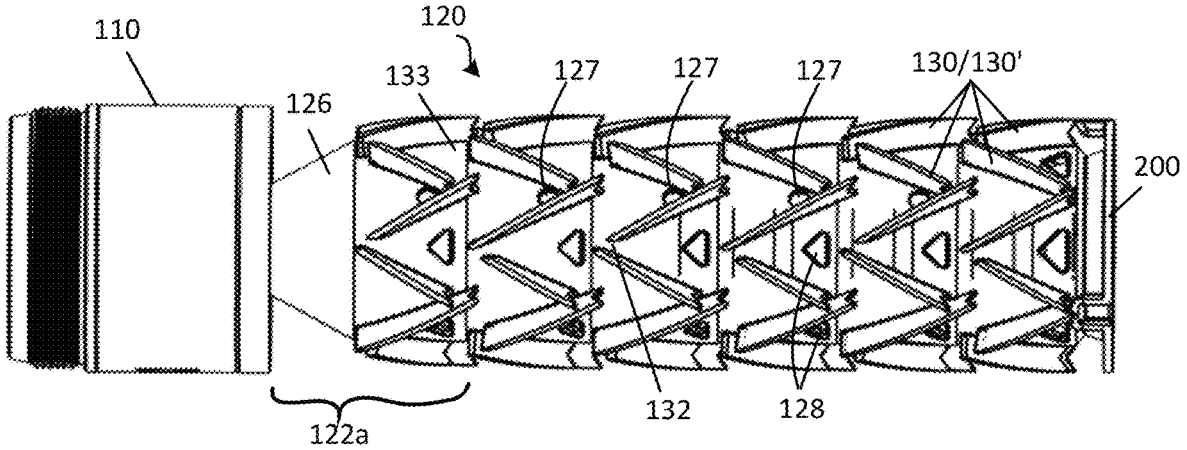
FIG. 5 illustrates a side view of a suppressor shown without the outer housing to reveal the baffle stack, in accordance with an embodiment of the present disclosure

FIG. 5 illustrates a side view of the suppressor 100 of FIG. 3 with the outer housing 102 removed to show the baffle stack 120. In this side view, inlet ports 127 are located in the vertex 132 of converging vanes 130' and outlet ports 128 are located in the open mouth 133 of diverging vanes 130'. In this example, outlet ports 128 are positioned along the sides and lower portion of the baffle stack 120 and inlet ports 127 are positioned along the upper portion of the baffle stack 120. As shown in this example, vanes 130' or other flow-directing structures 130 and ports 127, 128 can be arranged to augment the downward flow of gases through the suppressor 100 to more evenly fill the entire volume of the suppressor.

Figure 6:
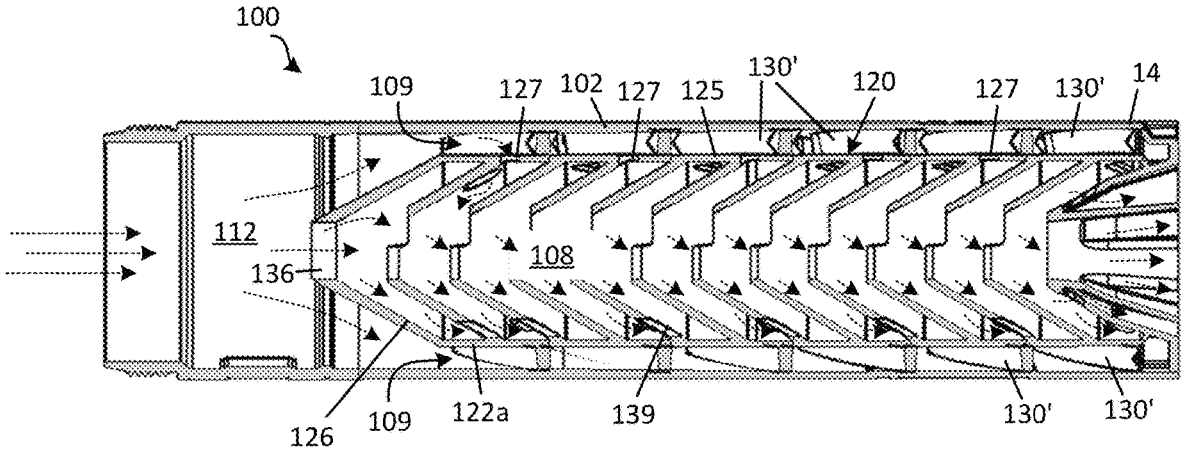
FIG. 6 illustrates a longitudinal section of a suppressor as viewed along line A-A of FIG. 1, in accordance with another embodiment of the present disclosure.
Figure 7:
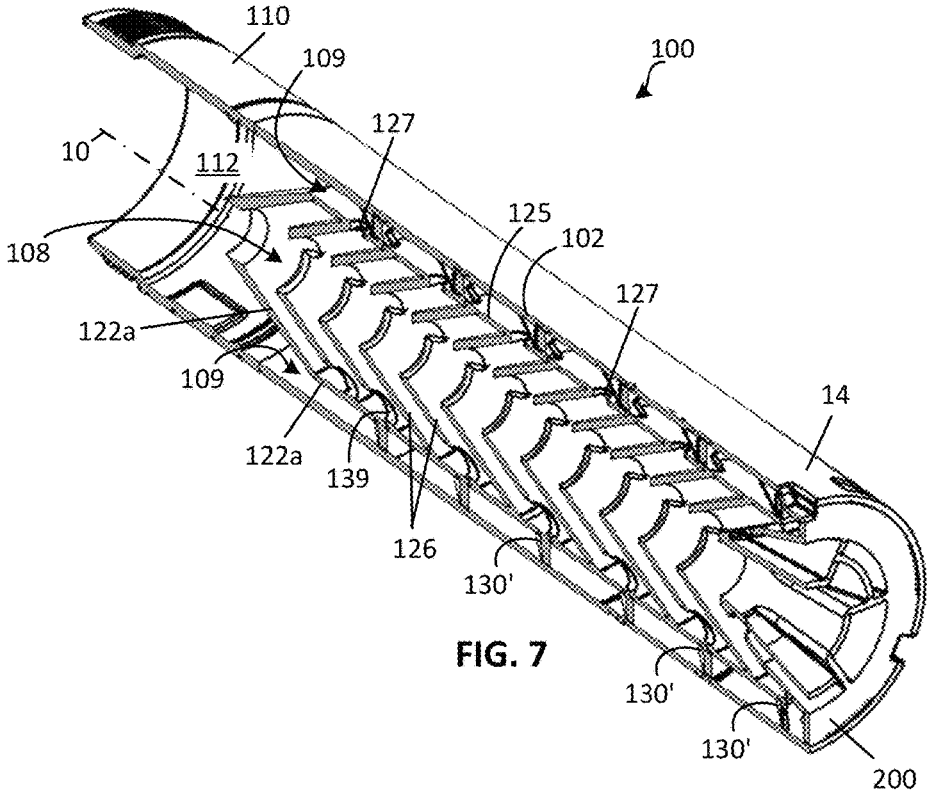
FIG. 7 illustrates a top, front and side perspective view of the longitudinal section of FIG. 6, in accordance with one embodiment of the present disclosure.

Referring now to FIGS. 6 and 7, a side view and a front perspective view, respectively, illustrate a longitudinal section of the suppressor 100, where the section is taken along line A-A shown in FIG. 1. The suppressor 100 defines an inner chamber 108 inside of the baffle stack wall 125 and an outer chamber 109 between the baffle stack wall 125 and the outer housing 102. As propellant gases enter the suppressor 100, initial expansion occurs in the blast chamber 112. A first portion of gases passes into the inner chamber 108 within the baffle stack 120 via the central opening 136 of the first baffle **122*a*. A second portion of gases passes into the outer chamber 109 by flowing around the baffle cone 126 of the first baffle 122*a*. Gases in the outer chamber 109 flow generally towards the distal end portion 14. Gases in the outer chamber 109 also can enter the inner chamber 108 through inlet ports 127 in the upper portion of the baffle stack wall 125. Gases can pass from one baffle cone 126 to another through vent openings 139 in some baffle cones 126. Arrows in FIG. 6 show example flow directions for some gases that move in a generally downward direction into and through the baffle stack 120. Features of individual baffles 122 and baffle stack 120** are discussed in more detail below.

Referring now to FIGS. 8-11, a baffle 122 is illustrated in a front perspective view, a rear perspective view, a side view, and a top view, respectively, in accordance with an embodiment of the present disclosure. Baffle 122 has a cylindrical baffle wall segment 124 and one or more baffle cones 126 connected to and tapering rearwardly from the baffle wall segment 124 to central opening 136 aligned with the central axis 10. The central opening 136 provides a pathway for a projectile along the central axis. In this example, the baffle 122 has two baffle cones 126 in a nested configuration, where each baffle cone 126 has a frustoconical geometry with a linear taper. The features of each baffle cone 126 are similar, and in some cases can be identical. Although this discussion pertains to the baffle cone 126 visible in FIGS. 8-11, many of the discussed features apply to both baffle cones 126, in accordance with some embodiments. Although baffle cones 126 are shown as having a linear taper, each baffle cone 126 can have a stepped profile or other non-linear taper, as will be appreciated. The axial length Lc of the baffle cone 126 is shown as being approximately equal to the axial length Lw of the baffle wall segment 124. This is not required and the axial length Lc of the baffle cone 126 can be greater or less than the axial length of Lw of the baffle wall segment 124 by 10%, 20%, 30%, 40%, 50%, or some other suitable value. For example, the projectile velocity, size, and powder charge of the shell can be factors that may favor one axial size over another, as will be appreciated.

In this example, a step 134 extends horizontally through the center of the central opening 136, dividing the central opening 136 into an upper portion **136*a* (e.g., an upper half) and a lower portion 136*b* (e.g., a lower half). As a result of the step 134, the upper portion 136*a* has an enlarged cross-sectional area compared to the lower portion 136*b*. Also, the step 134 results in an upper portion 136*a* of the central opening being positioned distally of the lower portion 136*b*, and therefore having a greater cross-sectional area when the step 134 is at or near the center of the central opening 136. The step 134 can be formed, for example, by machining away the upper part of the baffle cone 126 at the central opening 136. In other embodiments, the step 134 can be inclined to the horizontal and/or a can be above or below the center of the central opening 136. In yet other embodiments, the upper portion 136*a* can have an enlarged cross-sectional area as a result of a crescent-shaped recess, a bore formed at a downward angle to intersect the central opening 136 and increase the size of the upper portion 136*a* of the central opening 136**, a notch, or other feature.

Flow-directing structures 130 are connected to the outside of the baffle wall segment 124. Here, the flow-directing structures 130 are vanes 130'. Vanes 130' are arranged in a zig-zag pattern moving circumferentially around the baffle wall segment 124. As a result, circumferentially adjacent vanes 130' have either a diverging or converging arrangement, where the vertex 132 of each pair of vanes 130' is directed generally parallel to the central axis 10. In this example, the vanes 130' defining each vertex 132 do not make contact (or do not make complete contact) so as to define an opening 137 that permits gases to flow through the vertex 132. As can be seen, for example, in FIGS. 10-11, the vertex 132 adjacent the proximal end of the baffle wall segment 124 (a diverging vertex) has a larger opening **137*a* than the opening 137*b* of the vertex 132 (a converging vertex) adjacent the opposite (distal) end of the baffle wall segment 124. In some embodiments, each vertex 132 can have an opening 137 of the same or different size compared to other vertices 132. In other embodiments, an opening 137 between diverging vanes 130' can be greater or smaller than an opening 137 between converging vanes 130'**. Numerous variations and embodiments will be apparent in light of the present disclosure.

Figure 11:
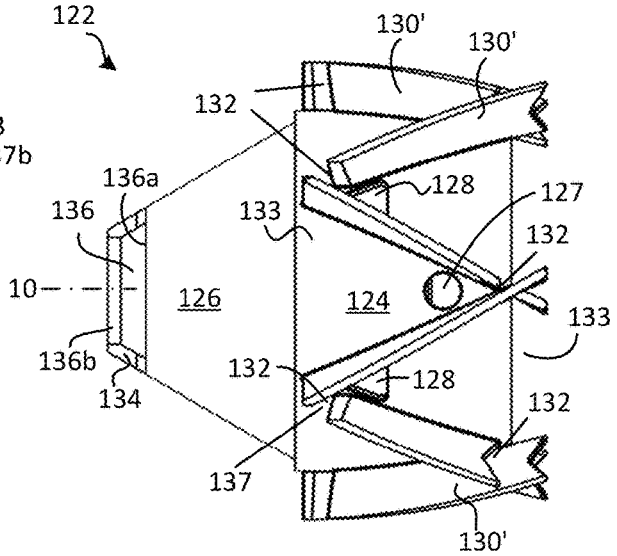
FIG. 11 illustrates a top view of the suppressor baffle of FIG. 8, in accordance with an embodiment of the present disclosure.

The baffle wall segment 124 can define one or more inlet ports 127 adjacent the vertex 132 of converging vanes 130'. Inlet ports 128 are positioned in the vertex 132 of diverging vanes 130' along the top of the baffle 122, such as shown in FIG. 11. In this example, the inlet port 127 is circular, but other shapes are acceptable. Outlet ports 128 are positioned in the open mouth 133 of diverging vanes 130' along the side and lower portion of the baffle wall segment 124. Outlet ports 128 in this example have a triangular shape, but other shapes are acceptable. Optionally, the baffle wall segment 124 can define additional inlet ports 127 and/or outlet ports 128 in various locations. Further, the lower portion of a given baffle cone 126 may define one or more vent openings 139 that permit passage of gases within the inner chamber 108, such as gases moving between adjacent baffle cones 126. As shown in this example, each vent opening 139 extends along a bore axis 140 that is generally parallel to the central axis, although this is not required. The bore axis 140 of the vent opening 139 can extend in an upward or downward direction in some embodiments.

Figure 12:
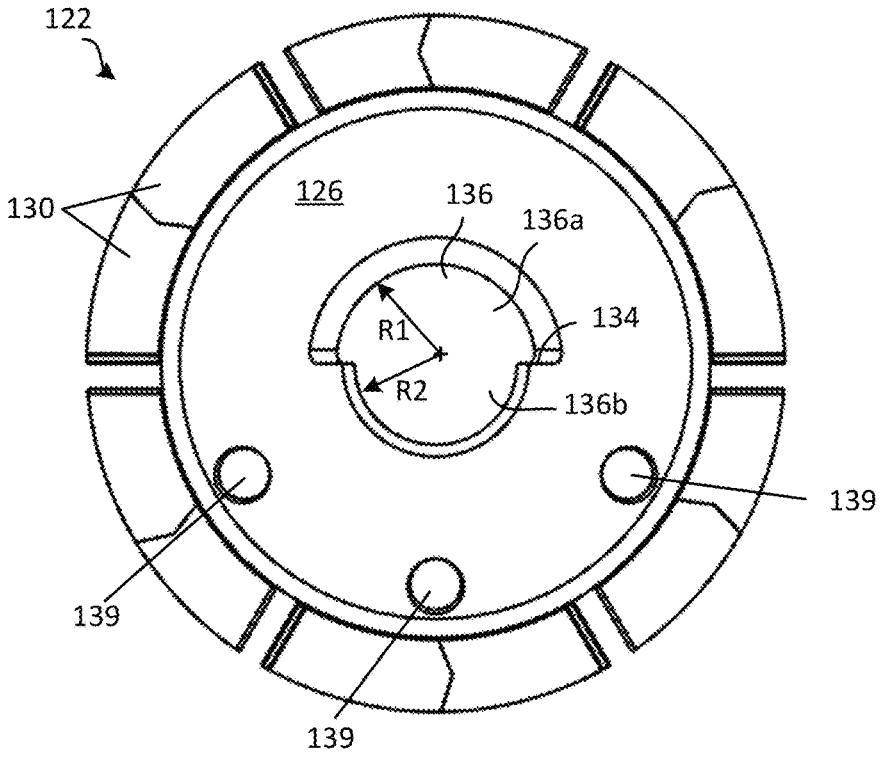
FIG. 12 illustrates a rear elevational view looking into a proximal end of the suppressor baffle of FIG. 8, in accordance with an embodiment of the present disclosure.
Figure 13:
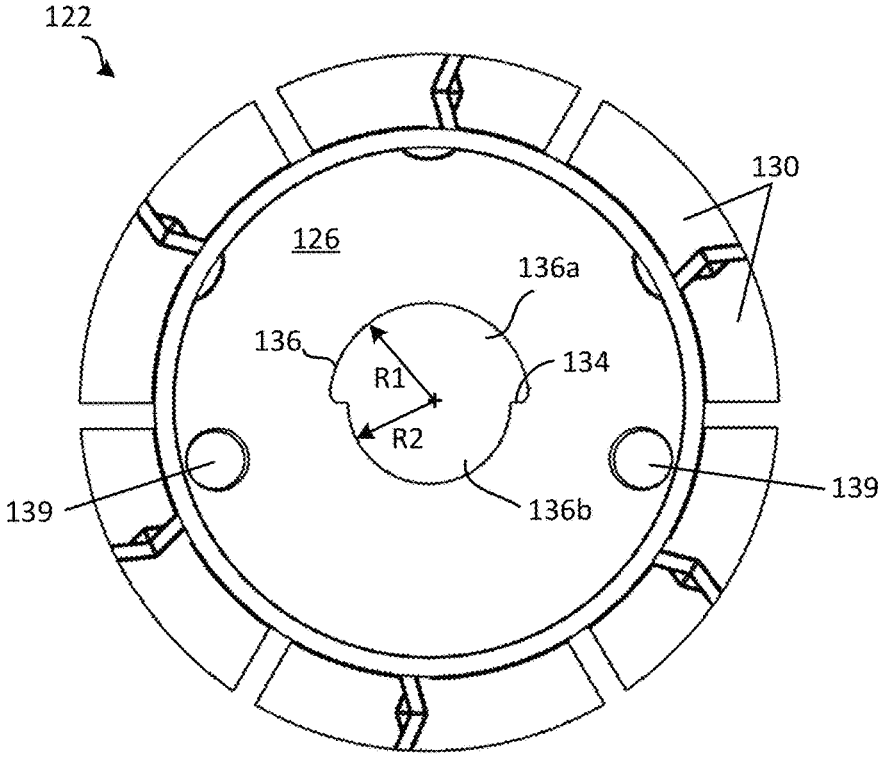
FIG. 13 illustrates a front elevational view looking into of the distal end of the suppressor baffle of FIG. 8, in accordance with an embodiment of the present disclosure.

FIGS. 12-13 illustrate rear and front views, respectively, of baffle 122 of FIGS. 8-11, in accordance with an embodiment. The central opening 136 of each baffle cone 126 defines a step 134 that results in an enlarged upper portion 136*a* of increased radius R1 compared radius R2 of the lower portion 136*b*. In this example, the step 134 extends horizontally through the center of the central opening 136. In other embodiments, the step 134 may be located above or below the center of the central opening 136. The greater area of the upper portion 136*a* promotes flow of gases through the central opening 136 in a downward direction while also providing a greater volume of gas to expand into the upper region of the inner chamber 108. Vent openings 139 in the lower half of the baffle cone 126 promote gas flow through the lower portion of the inner chamber 108, which facilitates a downward flow of gases in the baffle 122.

Figure 8:
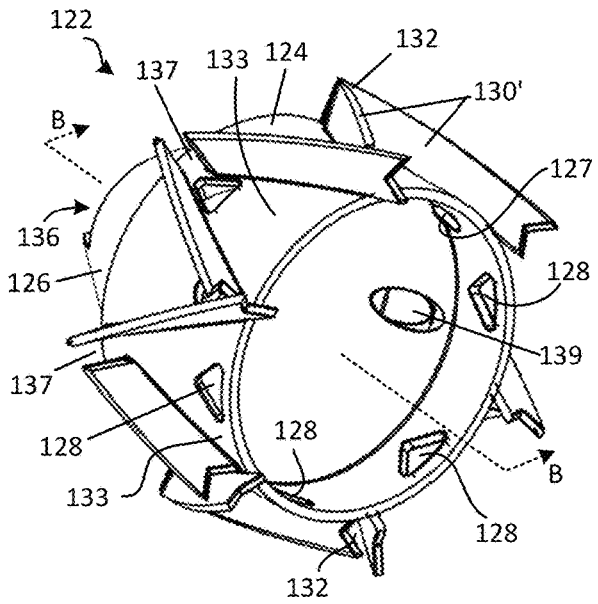
FIG. 8 illustrates a top, side, and front perspective view of a suppressor baffle, in accordance with an embodiment of the present disclosure.
Figure 9:
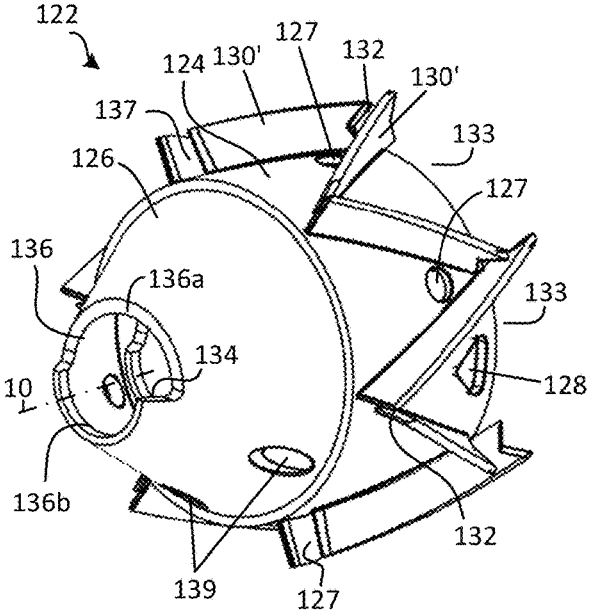
FIG. 9 illustrates a top, side, and rear perspective view of the suppressor baffle of FIG. 8, in accordance with an embodiment of the present disclosure.
Figure 10:
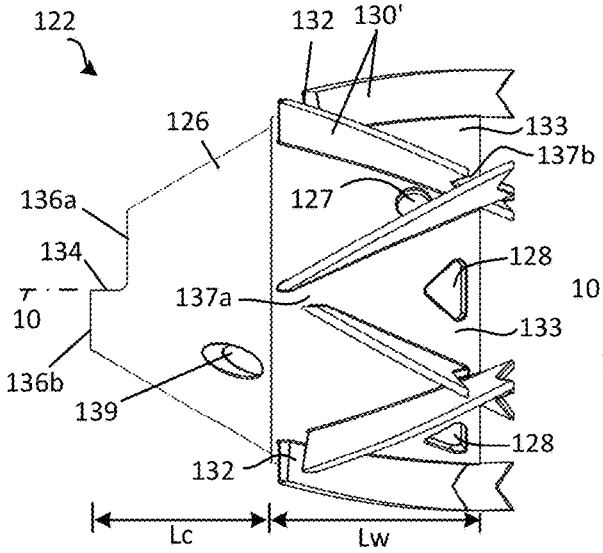
FIG. 10 illustrates a side view of the suppressor baffle of FIG. 8, in accordance with an embodiment of the present disclosure.
Figure 14:
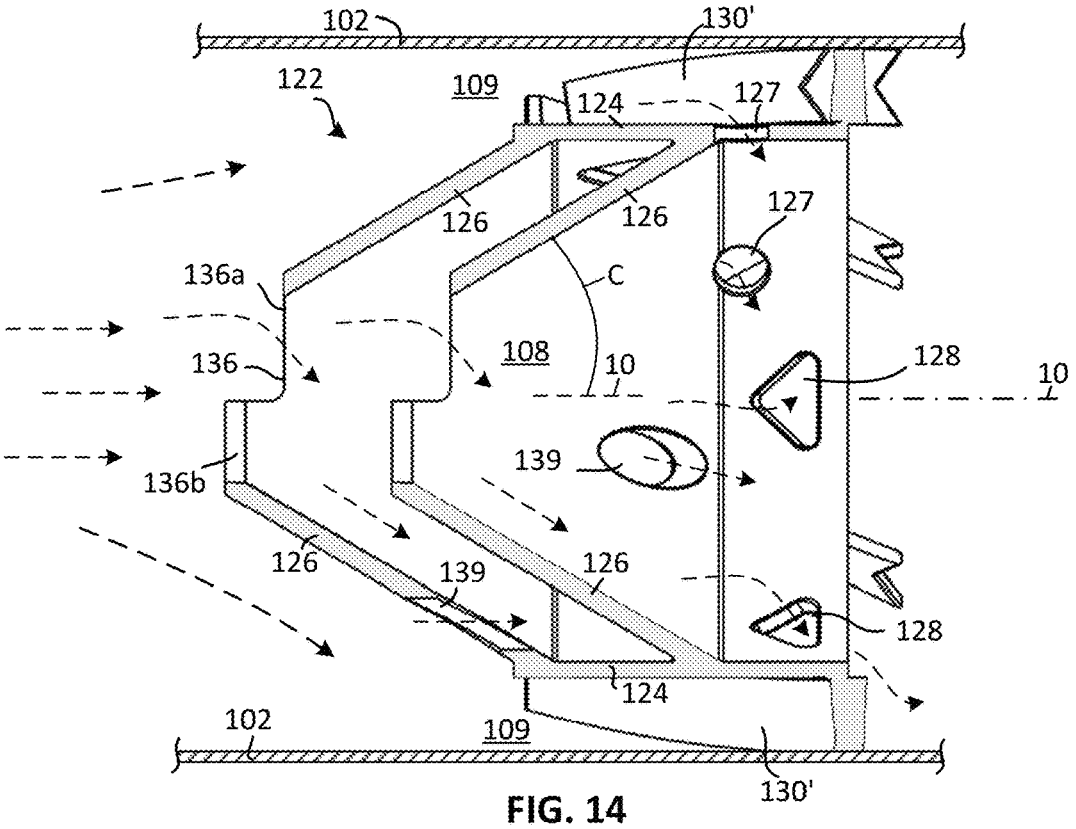
FIG. 14 illustrates a side view showing a portion of the outer housing together with a longitudinal section of a suppressor baffle as viewed along line B-B of FIG. 8, in accordance with an embodiment of the present disclosure.
Figure 15:
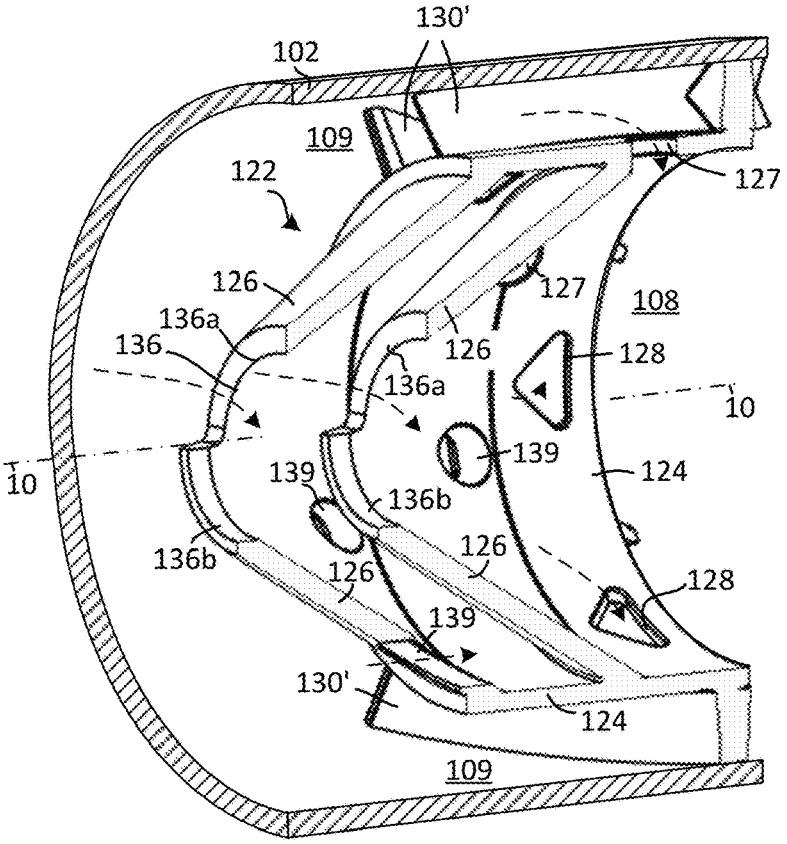
FIG. 15 illustrates a rear perspective view of the suppressor baffle and outer housing shown in FIG. 14, in accordance with an embodiment of the present disclosure.

Referring now to FIGS. 14 and 15, a side view and a rear perspective view, respectively, illustrate a sectional view of baffle 122 taken along a vertical plane and as viewed along line B-B of FIG. 8, in accordance with an embodiment of the present disclosure. Broken lines and arrows in these figures represent example gas flow paths. Note, however, that the arrows are for illustration only and may not represent all gas flows and may not accurately represent gas flow patterns that may change throughout the firing cycle, as will be appreciated.

One or more features of the baffle 122 can be included to promote a downward flow direction as gases move forward through the baffle 122. These features include the enlarged upper portion 136*a* of the central opening 136, the orientation of vanes 130' in diverging and converging pairs, placement of inlet ports 127 between converging vanes 130', placement of outlet ports 128 between diverging vanes 130', and vent openings 139 in the lower portion of the baffle cone 126. In addition, some embodiments have one feature that alternates with another feature in adjacent baffles 122 or adjacent baffle cones 126. These features can be present individually or in combination in a given baffle 122. Additionally, all baffles 122 or baffle cones 126 in the baffle stack 120 need not have the same features in all embodiments. For example, every other baffle cone 126 may include vent openings 139, or adjacent baffle cones 126 may define vent openings 139 in different locations from baffle to baffle. Numerous variations and embodiments will be apparent in light of the present disclosure.

When the baffle 122 is part of a suppressor 100 with outer housing 102, inner chamber 108 is defined inside of the baffle wall segment 124 and outer chamber 109 is defined between the wall segment 124 and the outer housing 102. The central opening 136 has an enlarged upper portion 136*a* that promotes gases to flow through the central opening 136 in a downward direction, such as in a direction normal to the largest cross-sectional area of the central opening 136. In one embodiment, gases flow through the central opening 136 in a direction approximately parallel to the wall of the baffle cone 126. The wall of each baffle cone 126 defines an angle C with the central axis 10 from 15-60 degrees, including 30-50 degrees, 20-40 degrees, 25-35 degrees, about 30 degrees, about 35 degrees, about 40 degrees, or about 45 degrees. Inlet ports 127 near the top of the baffle 122 direct gases downward into the baffle 122 due to the localized region of high pressure between converging vanes 130' in the outer chamber 109. Similarly, diverging vanes 130' results in a localized region of low pressure that draws gases out of the inner chamber 108 through outlet ports 128 in the lower portion of the baffle wall segment 124. This generally downward flow is facilitated by gases flowing through vent openings 139 in the lower portion of the baffle cone 126.

Figure 16:
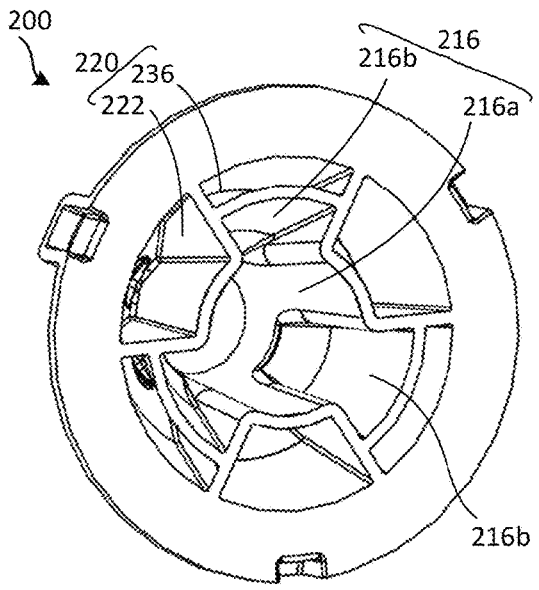
FIG. 16 illustrates a front perspective view of a flash hider for a suppressor, in accordance with an embodiment of the present disclosure.
Figure 17:
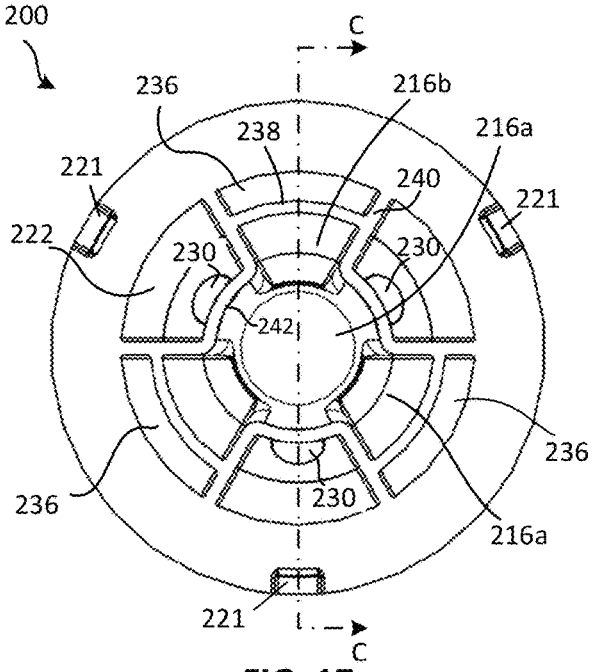
FIG. 17 illustrates a front elevational view of the flash hider of FIG. 16, in accordance with an embodiment of the present disclosure.
Figure 18:
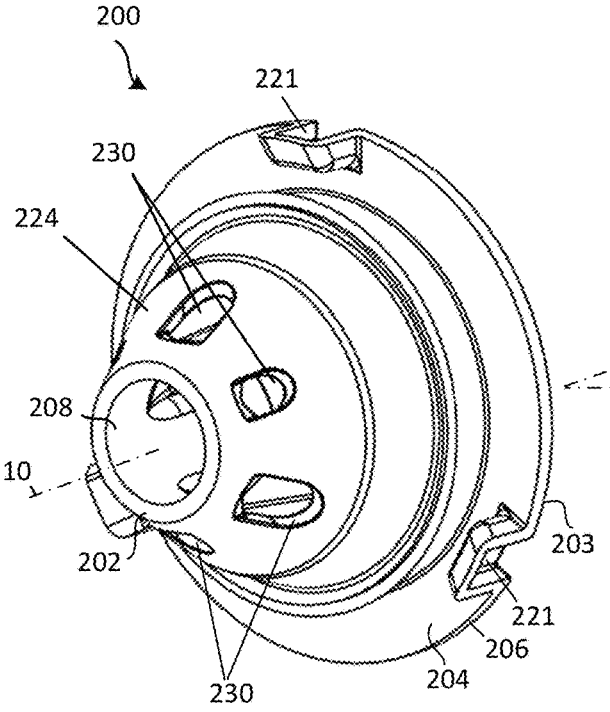
FIG. 18 illustrates a top, rear, and side perspective view showing the flash hider of FIG. 16, in accordance with an embodiment of the present disclosure.
Figure 19:
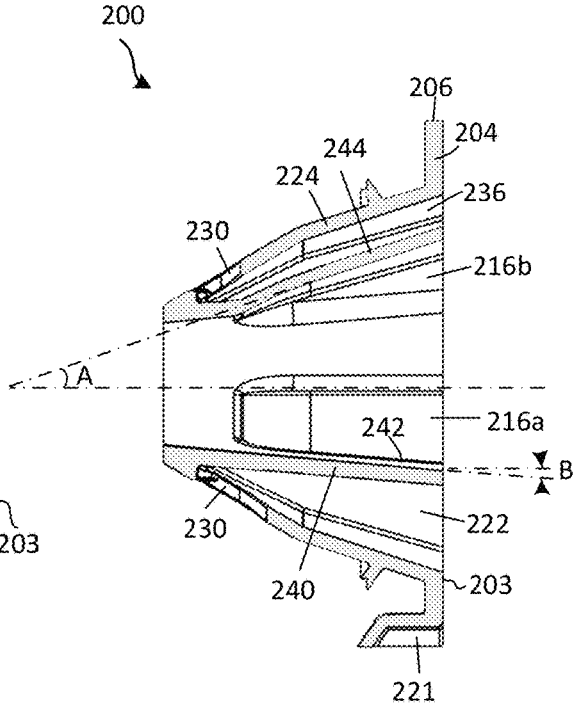
FIG. 19 illustrates a side view showing a longitudinal section of the flash hider as viewed along line C-C of FIG. 17, in accordance with an embodiment of the present disclosure.

Referring now to FIGS. 16-19, a flash hider 200 is shown in various views, in accordance with an embodiment of the present disclosure. FIG. 16 shows a front perspective view, FIG. 17 shows a front view, FIG. 18 shows a rear perspective view, and FIG. 19 shows a side view of a longitudinal section as taken along line C-C of FIG. 17.

The flash hider 200 extends along the central axis 10 from a proximal end 202 to a distal end 203. An outer wall 224 extends between and connects the proximal end 202 and distal end 203. The proximal end 202 defines a central opening 208 for passage of a projectile and gases. Ports 230 in the outer wall 224 provide an alternate entry point for gases to the flash hider 200. In this example, the flash hider 200 includes a flange or distal wall 204 extending radially outward from the distal end 203 of the outer wall 224. In some embodiments, the rim 206 of the distal wall 204 can be connected to the outer housing 102, such as by welding, a frictional fit, or a threaded connection.

The outer wall 224 defines an expanding volume as it extends distally. The outer wall 224 directs propellant gases away from the central axis 10 and controls the expansion of the propellant gases. In some embodiments, the outer wall 224 has a frustoconical shape that defines an outer wall angle A with respect to the central axis 10. Examples of acceptable values for the outer wall angle A include 10-45°, including 15°-20°, and 16-18°. In other embodiments, the outer wall 224 can have other cross-sectional shapes, such as a square, rectangle, hexagon, or other polygonal or elliptical shape. The outer wall 224 (or portions thereof) can have a linear or non-linear taper from the distal end 203 to the proximal end 202. Examples of a non-linear taper include a curved (e.g., elliptical or parabolic) or a stepped profile.

The volume within the outer wall 224 includes a first flash hider portion 216 and a second flash hider portion 220. The first flash hider portion 216 vents a first portion of gases that enter the flash hider 200 through the central opening 208. The second flash hider portion 220 vents a second portion of gases that enter the flash hider 200 through one or more ports 230 in the outer wall 224. The first flash hider portion 216 includes an inner volume 216*a* with a conical shape that expands distally from the central opening 208. The inner volume 216*a* is circumscribed by and defined in part by the radially inner faces 242 of the flow partitions 240. The first flash hider portion 216 also includes first outer volumes 216*b* positioned radially outside of and continuous with the inner volume 216*a*, which has a frustoconical shape in this example. Each first outer volume 216*b* is radially between the inner volume 216*a* and the circumferential wall 244. Each first outer volume 216*b* is also located circumferentially between adjacent flow partitions 240 of the second flash hider portion 220. The first portion of gases enter through the central opening 208 and can expand along the inner volume 216*a* and can further expand into the first outer volumes 216*b*.

In one example, the inner volume 216*a* has a frustoconical geometry extending along the central axis 10. In some such embodiments, the inner faces 242 of the flow partitions 240 have an inner wall angle B (shown in FIG. 19) with the central axis 10 from 4-15°, including 5-8°, or 6-7°, for example. Such a value for the inner wall angle B has been found to slow down propellant gases exiting to the environment as well as to reduce the amount of hot propellant gases that mix with ambient air/oxygen. Accordingly, and without being constrained to any particular theory, it is believed that such an inner wall angle B permits adequate gas expansion yet also desirably reduces the size of a "Mach disk" or "flow diamond"—appearing as an orange or red flash—as propellant gases transition from supersonic to subsonic flow.

The second flash hider portion 220 includes a plurality of radially outer volumes 222 that are interspersed circumferentially with the first outer volumes 216*b* of the first flash hider portion 216. The radially outer volumes 222 are defined within flow partitions 240 connected to the outer wall 224. In this example, each flow partition 240 connects to the proximal end 202 of the flash hider 200 adjacent the central opening 208 and extends forward to the distal end 203. Accordingly, each flow partition 240 isolates one of the radially outer volumes 222 from the first flash hider portion 216 and in part defines the inner volume 216*a* of the first flash hider portion 216. In this example, three radially outer volumes 222 generally resemble sectors of an annular region located between the frustoconical inner volume 216*a* and the outer wall 224. The second flash hider portion 220 can have other numbers of second outer volumes, such as two, four, or some other number. In one example, each flow partition 240 generally has a U shape as viewed from the distal end 203. The flow partitions 240 can be rectangular, rounded, or have some other geometry. The radially outer volumes 222 are distributed and spaced circumferentially about the central axis 10 and are located radially outside of the inner volume 216*a* of the first flash hider portion 216. In some embodiments, all flow partitions 240 have the same dimensions and are evenly distributed about the central axis 10, although this is not required.

The second flash hider portion 220 optionally also includes additional second outer volumes 236 that are positioned laterally between adjacent flow partitions 240 and radially between the outer wall 224 and a circumferential wall 244 between adjacent flow partitions 240. In this example, each additional second outer volume 236 is located radially outside of the first outer volume 216*b* of the first flash hider portion 216, so that a first outer volume 216*b* and an additional second outer volume 236 share a region between adjacent flow partitions 240 and are separated by the circumferential wall 244. The additional second outer volumes 236 are shown as having a reduced cross-sectional area compared to the radially outer volumes 222, but this is not required. For example, each additional second outer volume 236 can have a reduced radial dimension, but a greater circumferential dimension compared to these dimensions of the radially outer volumes 222, resulting in a cross-sectional area that is about equal to or even greater than that of the radially outer volume 222.

Gases can enter the radially outer volumes 222 of the second flash hider portion 220 via ports 230 in the proximal portion of the outer wall 224. When the flash hider 200 is part of a suppressor assembly, some or all of the gases flowing through the suppressor along a radially outer flow path can enter the second flash hider portion 220 through ports 230. Absent any openings through the flow partition 240, and absent any gases entering the second flash hider portion 220 through the distal end 203, gases entering the central opening 208 are isolated from and cannot flow through the radially outer volumes 222 of the second flash hider portion 220.

One advantage of venting radially outer volumes or off-axis flow of the suppressor 100 is to reduce pressure of the gases flowing along the central axis 10. In doing so, flash is also reduced. Venting through the second flash hider portion 220 also can reduce pressure in the suppressor and therefore reduce back flow of gases into the firearm's chamber, such as when used with semi-automatic or automatic rifles. Further, isolating the gas flow through the second flash hider portion 220 from the first flash hider portion 216 can inhibit mixing and turbulence of gases exiting the flash hider 200, and therefore reduces the visible signature of the firearm, as will be appreciated.

As will be appreciated in light of the present disclosure, a suppressor assembly 100 provides multiple gas flow paths that can be configured to reduce the audible and visible signature of the firearm. As discussed above, combustion gases can be divided into two volumes of gas that are largely separated from each other to more evenly and more completely fill the entire volume of the suppressor 100. These gas volumes pass through the corresponding inner and outer chambers (with some mixing therebetween) before exiting the suppressor 100 through a flash hider 200. Flow of part of the gases through the outer chamber can significantly reduce the back flow of pressurized gases into the firearm. This mixing of gases between the inner chamber 108 and outer chamber 109 allows for better filling of the chambers by the combustion gases, longer flow paths, increased gas turbulence, better cooling, and a faster reduction in total energy of the gases. These in turn, can produce the benefits described above.

It will be appreciated that the gases flowing through the inner chamber 108 are slowed and/or cooled by the operation of the baffles 122, which additionally induce localized turbulence and energy dissipation, thus reducing (or "suppressing") the sound and/or flash of expanding gases. For example, as the gases collide with baffles 122 and other surfaces in the suppressor, the gases converge and then expand again in a different direction, for example. The various collisions and changes in velocity (direction and/or speed) result in localized turbulence, an elongated flow path, and heat and energy losses from the gases, thereby reducing the audible and visual signature of the rifle.

FURTHER EXAMPLE EMBODIMENTS

The following examples pertain to further embodiments, from which numerous permutations and configurations will be apparent.

Example 1 is a suppressor comprising a hollow tubular housing extending longitudinally along a central axis from a proximal end to a distal end; a baffle stack within the hollow tubular housing and extending along the central axis from a proximal baffle stack end to a distal baffle stack end, the baffle stack comprising an annular baffle wall and a plurality of baffle cones connected to an inside of the baffle wall, each of the baffle cones extending rearward to a central opening, wherein the baffle stack defines a projectile pathway along the bore axis, an inner volume inside of the annular baffle wall, and an outer volume between the annular baffle wall and the hollow tubular housing; flow-directing structures in the outer volume, the flow-directing structures including pairs of converging vanes and pairs of diverging vanes; wherein the annular baffle defines inlet ports in an upper half of the annular baffle wall and positioned between pairs of converging vanes; and the annular baffle wall defines outlet ports in a lower half of the annular baffle wall and positioned between pairs of diverging vanes.

Example 2 includes the subject matter of Example 1 and further comprises a flash hider aligned with and located distally of the baffle stack, the flash hider connected to the distal end of the hollow tubular housing.

Example 3 includes the subject matter of Examples 1 or 2, wherein at least some of the baffle cones define one or more vent openings.

Example 4 includes the subject matter of Example 3, wherein the one or more vent openings are defined in every other baffle cone of at least a portion of the baffle stack.

Example 5 includes the subject matter of Exampled 3 or 4, wherein the one or more vent openings are in a lower half of the baffle cone.

Example 6 includes the subject matter of any of Examples 1-5, wherein each baffle cone has an axial overlap with an adjacent baffle cone. For example, the axial overlap is from 40% to 60% of an axial length of the baffle cone.

Example 7 includes the subject matter of Example 6, wherein, except for a first baffle cone, the central opening of each baffle cone is received in the baffle cone of a proximally adjacent baffle cone.

Example 8 includes the subject matter of any of Examples 1-7, wherein the central opening of at least some baffle cones has a shape that promotes downward flow through the central opening.

Example 9 includes the subject matter of Example 8, wherein a cross-sectional area of an upper portion of the central opening is greater than a cross-sectional area of a lower portion of the central opening.

Example 10 includes the subject matter of Example 8, wherein the central opening defines a notch, a recess, or step that provides a greater area of an upper portion of the central opening compared to an area of a lower portion of the central opening. For example, the central opening defines a step as viewed from the side, such that an upper portion of the central opening is positioned distally of a lower portion of the central opening.

Example 11 includes the subject matter of any of Examples 1-10, wherein the flow-directing structures include vanes arranged in a zig-zag around at least a part of a circumference of the baffle stack, the vanes including pairs of converging vanes and pairs of diverging vanes.

Example 12 includes the subject matter of Example 11, wherein vertices of the converging vanes are aligned along one or more first lines generally parallel to the longitudinal axis, and wherein vertices of the diverging vanes are aligned along one or more second lines generally parallel to the longitudinal axis, the first lines alternating with the second lines around the outside of the baffle stack.

Example 13 includes the subject matter of Example 11 or 12, wherein the vanes generally define a herringbone pattern on the outside of the baffle stack.

Example 14 includes the subject matter of Example 13, wherein the herringbone pattern includes circumferential rows of vanes and axial columns of vanes, wherein adjacent vanes in the circumferential rows alternate to define a zig-zag around the baffle stack.

Example 15 includes the subject matter of any of Examples 11-14, wherein individual vanes have a helical shape.

Example 16 includes the subject matter of any of Examples 1-15, wherein the inlet ports are positioned adjacent a vertex of the converging vanes.

Example 17 includes the subject matter of any of Examples 1-16, wherein at least some of the outlet ports are positioned in an open mouth of the diverging vanes.

Example 18 includes the subject matter of any of Examples 1-17 and further comprises an end cap.

Example 19 includes the subject matter of Example 18, wherein the endcap is configured as a flash suppressor.

Example 20 is a suppressor baffle comprising an annular baffle wall extending axially along a longitudinal axis from a first end to a second end; one or more baffle cones connected to the annular baffle wall and extending along the longitudinal axis away from the annular baffle wall, each of the one or more baffle cones defining a central opening aligned with the longitudinal axis; and a plurality of flow-directing structures on an outside of the annular baffle wall, the flow-directing structures including vanes on an outside of the annular baffle wall and oriented transversely to the longitudinal axis, the vanes including at least one pair of converging vanes and at least one pair of diverging vanes, wherein each pair of the at least one pair of converging vanes and the at least one pair of diverging vanes generally defines a vertex and an open mouth opposite the vertex.

Example 21 includes the subject matter of Example 20, wherein the one or more baffle cones includes a plurality of baffle cones connected to an inside of the annular baffle wall and distributed in a spaced-apart arrangement along the annular baffle wall.

Example 22 includes the subject matter of Example 21, wherein the plurality of baffle cones includes at least six baffle cones.

Example 23 includes the subject matter of Example 21 or 22, wherein the central opening of some baffle cones is within a volume of a proximally adjacent baffle cone.

Example 24 includes the subject matter of any of Examples 21-23, wherein each baffle cone of the plurality of baffle cones has an axial overlap with an adjacent baffle cone, the axial overlap from 40% to 60% of an axial length of the adjacent baffle cone.

Example 25 includes the subject matter of any of Examples 20-24, wherein the vertex is an open vertex permitting gas flow through the vertex.

Example 26 includes the subject matter of any of Examples 20-25, wherein an imaginary line through the vertex and a center of the open mouth is substantially parallel to the longitudinal axis.

Example 27 includes the subject matter of any of Examples 20-26, wherein the annular baffle wall is cylindrical.

Example 28 includes the subject matter of any of Examples 20-27, wherein the annular baffle wall defines an inlet port between some of the converging vanes.

Example 29 includes the subject matter of Example 28, wherein the inlet port is adjacent the vertex.

Example 30 includes the subject matter of any of Examples 28-30, wherein the inlet port is between the second baffle cone and the second end of the annular baffle wall.

Example 31 includes the subject matter of any of Examples 20-30, wherein the annular baffle wall defines an outlet port between some of the diverging vanes.

Example 32 includes the subject matter of Example 31, wherein the outlet port is adjacent the open mouth.

Example 33 includes the subject matter of any of Examples 31-32, wherein the outlet port is between the second baffle cone and the second end of the annular baffle wall.

Example 34 includes the subject matter of any of Examples 20-33, wherein a lower portion of the one or more baffle cones defines a vent opening between the central opening and the annular baffle wall.

Example 35 includes the subject matter of any of Examples 21-24, wherein a lower portion of the first baffle cone defines a vent opening between the central opening and the annular baffle wall.

Example 36 includes the subject matter of any of Examples 20-34, wherein an upper half of the central opening has a greater area than the lower half of the central opening.

Example 37 includes the subject matter of Example 36, wherein the central opening has a stepped shape.

Example 38 includes the subject matter of Examples 36 or 37, wherein the upper half of the central opening has a greater radius than the lower half of the central opening.

Example 39 includes the subject matter of Example 36, wherein the central opening defines a notch, a recess, or step that enlarges the upper half of the central opening.

Example 40 includes the subject matter of any of Examples 20-39, wherein the vanes are arranged in a zig-zag pattern around a circumference of the annular baffle wall.

Example 41 includes the subject matter of any of Examples 20-40, wherein each of the vanes follows a helical path.

Example 42 is a suppressor baffle stack including one or more suppressor baffle of Examples 20-41.

Example 43 includes the subject matter of Example 42, wherein the one or more suppressor baffle includes at least three suppressor baffles.

Example 44 is a suppressor comprising the baffle stack of Examples 42 or 43.

Example 45 is a suppressor comprising a baffle stack having a cylindrical wall around an inner volume and extending along a central axis and a plurality of baffle cones connected to the cylindrical wall, individual baffle cones having a conical taper extending rearwardly to a central opening; an outer housing around the baffle stack, the outer housing having an inner surface spaced from and confronting the cylindrical wall, the inner surface of the outer housing and the outer surface of cylindrical wall defining an outer volume therebetween; a plurality of vanes in the outer volume, wherein the plurality of vanes includes pairs of diverging vanes and pairs of converging vanes with respect to gases flowing distally through the suppressor; and an end cap connected to a distal end of the outer housing, the end cap defining a central opening aligned with the central axis.

Example 46 includes the subject matter of Example 45 and further comprises a mount connected to a proximal end portion of the housing, the mount defining a blast chamber.

Example 47 includes the subject matter of Example 45 or 46, wherein the cylindrical wall comprises a plurality of cylindrical wall segments.

Example 48 includes the subject matter of any of Examples 45-47, wherein adjacent baffle cones are nested such that the central opening of one baffle cone is within a volume of a proximally adjacent baffle cone.

Example 49 includes the subject matter of any of Examples 45-48, wherein at least some of the baffle cones further define a vent opening in the conical taper.

Example 50 includes the subject matter of any of Examples 45-49, wherein an upper half of the central opening of at least some of the plurality of baffle cones has a greater area than a lower half of the central opening.

Example 51 includes the subject matter of any of Examples 44-52, wherein the central opening of at least some baffle cones of the plurality of baffle cones defines a step.

Example 52 includes the subject matter of Example 48, wherein the central opening defines a feature providing a greater area of the upper half of the central opening, the feature selected from a notch, a step, and a recess.

Example 53 includes the subject matter of any of Examples 18-19 or 43-52, wherein the end cap is configured as a flash hider including a first flash hider portion configured to vent a first portion of gases flowing along the central axis and a second flash hider portion configured to vent a second portion of gases in a radially outer portion of the suppressor.

Example 54 includes the subject matter of Example 53, wherein the flash hider comprises an outer wall defining a central flash hider opening and a plurality of ports in the outer wall; the first flash hider portion including an inner volume expanding along the central axis from the central flash hider opening; and the second flash hider portion including a plurality of radially outer volumes positioned radially outside of the first portion, each of the radially outer volumes in fluid communication with one or more of the ports.

Example 55 includes the subject matter of Example 54, wherein the radially outer volumes are isolated from the inner volume along an axial length of the flash hider.

Example 56 includes the subject matter of Example 54 or 55, wherein the first flash hider portion further includes outer volumes interspersed circumferentially with the radially outer volumes of the second flash hider portion, the outer volumes continuous with the inner volume of the first flash hider portion.

Example 57 includes the subject matter of Example 53, wherein the flash hider comprises a flash hider proximal end portion defining a central entrance opening; an outer wall extending along the central axis from the flash hider proximal end portion to the end cap, the outer wall expanding in size moving from the proximal end portion to the end cap and connected to the end cap at the central opening of the end cap; and flow partitions extending inward from the outer wall toward the central axis, the flow partitions distributed about the central axis in a circumferentially spaced-apart arrangement, each of the flow partitions generally having a shape of an anulus sector with sides and a radially inner surface; wherein the flash hider defines (i) an inner volume that expands along the central axis between the flash hider proximal end portion and the end cap, the inner volume circumscribed by the radially inner surface of the flow partitions, and (ii) a plurality of outer volumes located radially outside of the inner volume and continuous with the inner volume, the plurality of outer volumes interspersed circumferentially with the flow partitions.

Example 58 includes the subject matter of Example 57, wherein the sides of each flow partition extend generally in parallel, or generally in a radial direction, from the outer wall.

Example 59 includes the subject matter of any of Examples 57-58, wherein each of the flow partitions defines a gas passageway between the sides, the outer wall, and the radially inner surface, wherein the gas passageway is isolated from the inner volume and the outer volumes along an axial length of the flash hider, and wherein the gas passageway is in direct or indirect fluid communication with the outer chamber via a vent opening in the outer wall of the flash hider.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A suppressor comprising:

a hollow tubular housing extending longitudinally along a central axis from a proximal end to a distal end;

a baffle stack within the hollow tubular housing and extending along the central axis from a proximal baffle stack end to a distal baffle stack end, the baffle stack comprising an annular baffle wall and a plurality of baffle cones connected to an inside of the baffle wall, each of the baffle cones extending rearward to a central opening, wherein the baffle stack defines a projectile pathway along the bore axis, an inner volume inside of the annular baffle wall, and an outer volume between the annular baffle wall and the hollow tubular housing; and flow-directing structures in the outer volume, the flow-directing structures including pairs of converging vanes and pairs of diverging vanes;

wherein the annular baffle wall defines inlet ports in an upper half of the annular baffle wall, the inlet ports positioned between pairs of converging vanes; and wherein the annular baffle wall defines outlet ports in a lower half of the annular baffle wall, the outlet ports positioned between pairs of diverging vanes.

2. The suppressor of claim 1 further comprising:

a flash hider aligned with and located distally of the baffle stack, the flash hider connected to the distal end of the hollow tubular housing.

3. The suppressor of claim 1, wherein at least some of the baffle cones define one or more vent openings.

4. The suppressor of claim 3, wherein the one or more vent openings are defined in every other baffle cone of at least a portion of the baffle stack.

5. The suppressor of claim 3, wherein the one or more vent openings are in a lower half of the baffle cone.

6. The suppressor of claim 1, wherein except for a first baffle cone, each baffle cone has an axial overlap with an adjacent baffle cone such that the central opening of one baffle cone is received in a volume of a proximally adjacent baffle cone.

7. The suppressor of claim 1, wherein a cross-sectional area of an upper portion of the central opening is greater than a cross-sectional area of a lower portion of the central opening.

8. The suppressor of claim 1, wherein the central opening defines a step as viewed from the side, such that an upper portion of the central opening is positioned distally of a lower portion of the central opening.

9. The suppressor of claim 1, wherein the pairs of converging vanes and pairs of diverging vanes define a zig-zag pattern that extends at least part way around a circumference of the baffle stack.

10. The suppressor of claim 9, wherein individual vanes of the pairs of converging vanes and pairs of diverging vanes have a helical shape.

11. The suppressor of claim 1, wherein vertices of pairs of converging vanes are aligned along first axes generally parallel to the longitudinal axis, and wherein vertices of pairs of diverging vanes are aligned along second axes generally parallel to the longitudinal axis, the first axes interspersed with the second axes around the baffle stack.

12. The suppressor of claim 1, wherein the pairs of converging vanes and the pairs of diverging vanes define a herringbone pattern including circumferential rows of vanes and axial columns of vanes, wherein adjacent vanes in the circumferential rows have an alternating orientation with respect to the central axis.

13. The suppressor of claim 1, further comprising an end cap configured as a flash suppressor, the flash hider including a first flash hider portion configured to vent a first portion of gases from the inner volume and a second flash hider portion configured to vent directly or indirectly a second portion of gases from the outer volume.

14. A suppressor comprising:

a baffle stack having a cylindrical wall around an inner volume and extending along a central axis and a plurality of baffle cones connected to the cylindrical wall, individual baffle cones having a conical taper extending rearwardly to a central opening;

an outer housing around the baffle stack, the outer housing having an inner surface spaced from and confronting the cylindrical wall, the inner surface of the outer housing and the outer surface of cylindrical wall defining an outer volume therebetween;

a plurality of vanes in the outer volume, wherein the plurality of vanes includes pairs of diverging vanes and pairs of converging vanes with respect to gases flowing distally through the suppressor; and an end cap connected to a distal end of the outer housing, the end cap defining a central opening aligned with the central axis.

15. The suppressor of claim 14, wherein at least some of the baffle cones further define a vent opening in the conical taper.

16. The suppressor of claim 14, wherein the cylindrical wall of the baffle stack defines inlet ports located an upper half of the cylindrical wall between pairs of converging vanes and defines outlet ports in a lower half of the annular baffle wall between pairs of diverging vanes.

17. The suppressor of claim 16, wherein a cross-sectional area of an upper portion of the central opening is greater than a cross-sectional area of a lower portion of the central opening.

18. The suppressor of claim 14, wherein the central opening of at least some baffle cones of the plurality of baffle cones defines a step as viewed from a side of the suppressor, such that an upper portion of the central opening is spaced distally along the central axis from a lower portion of the central opening.

19. The suppressor of claim 14, wherein the end cap is configured as a flash hider, the flash hider including a first flash hider portion configured to vent a first portion of gases from the inner volume and a second flash hider portion configured to vent directly or indirectly a second portion of gases from the outer volume.

20. The suppressor of claim 19, wherein the first flash hider portion includes a conical inner wall defining a central flash hider opening at a proximal end and expanding moving distally along the central axis from the central flash hider opening, and wherein the second flash hider portion includes an outer wall around the conical inner wall, the outer wall defining a plurality of openings in fluid communication with the outer volume of the suppressor.

* * * * *